US009750361B2

(12) United States Patent
Hyde et al.

(10) Patent No.: US 9,750,361 B2
(45) Date of Patent: Sep. 5, 2017

(54) ODORANT-RELEASING UTENSIL

(71) Applicant: Elwha LLC, Bellevue, WA (US)

(72) Inventors: Roderick A. Hyde, Redmond, WA (US); Muriel Y. Ishikawa, Livermore, CA (US); Edward K. Y. Jung, Bellevue, WA (US); Jordin T. Kare, Seattle, WA (US); Robert Langer, Newton, MA (US); Eric C. Leuthardt, St. Louis, MO (US); Nathan P. Myhrvold, Medina, WA (US); Dennis J. Rivet, Chesapeake, VA (US); Elizabeth A. Sweeney, Seattle, WA (US); Clarence T. Tegreene, Mercer Island, WA (US); Lowell L. Wood, Jr., Bellevue, WA (US); Victoria Y. H. Wood, Livermore, CA (US)

(73) Assignee: Elwha LLC, Bellevue, WA (US)

( * ) Notice: Subject to any disclaimer, the term of this patent is extended or adjusted under 35 U.S.C. 154(b) by 339 days.

(21) Appl. No.: 14/260,908

(22) Filed: Apr. 24, 2014

(65) Prior Publication Data

US 2014/0312135 A1 Oct. 23, 2014

Related U.S. Application Data

(63) Continuation-in-part of application No. 13/675,935, filed on Nov. 13, 2012, now Pat. No. 9,357,865, and (Continued)

(51) Int. Cl.
*A47G 21/04* (2006.01)
*A47G 21/02* (2006.01)
(Continued)

(52) U.S. Cl.
CPC ..... *A47G 21/04* (2013.01); *A47G 19/2227* (2013.01); *A47G 21/02* (2013.01); *A47G 23/0216* (2013.01); *A47G 2400/04* (2013.01)

(58) Field of Classification Search
CPC .... A47G 21/02; A47G 21/04; A47G 2400/04; A47G 19/2227; A47G 23/0216
(Continued)

(56) References Cited

U.S. PATENT DOCUMENTS 3,252,803 A 5/1966 Belasco
3,410,457 A * 11/1968 Brown ..... A47G 21/004 222/191
(Continued)

FOREIGN PATENT DOCUMENTS

WO WO 89/10117 A1 11/1989
WO WO 2010/059725 A1 5/2010

OTHER PUBLICATIONS

U.S. Appl. No. 13/675,942, Baym et al.
(Continued)

*Primary Examiner* — Phong Nguyen

(57) ABSTRACT

In an aspect, an eating utensil includes a controllable odorant emitter for delivering an odorant to a person who is eating or drinking from the eating utensil. The odorant may be delivered orthonasally or retronasally. The odorant may be used to stimulate or suppress appetite. In an aspect, a controllable odorant emitter is provided in an attachment that may be removably secured to an eating utensil. Related methods and systems for delivering odorant in connection with use of an eating utensil are described.

17 Claims, 23 Drawing Sheets

Related U.S. Application Data a continuation-in-part of application No. 13/675,940, filed on Nov. 13, 2012, now Pat. No. 9,462,822, and a continuation-in-part of application No. 13/675,942, filed on Nov. 13, 2012.

(51) Int. Cl.
*A47G 19/22* (2006.01)
*A47G 23/02* (2006.01)

(58) Field of Classification Search
USPC ..... 30/124, 125, 129, 141, 148, 149, 150, 30/322–328
See application file for complete search history.

(56) References Cited

U.S. PATENT DOCUMENTS 4,387,777 A 6/1983 Ash
4,918,391 A 4/1990 Byrd
4,999,208 A 3/1991 Lengerich et al.
5,388,043 A 2/1995 Hettinger
5,398,070 A 3/1995 Lee
5,411,538 A 5/1995 Lin
5,525,367 A 6/1996 King et al.
5,769,833 A 6/1998 Hasse
5,824,554 A 10/1998 McKay
5,943,950 A 8/1999 Taoda et al.
6,053,738 A 4/2000 Ivey, Jr.
6,416,740 B1 7/2002 Unger
6,425,862 B1 7/2002 Brown
6,461,873 B1 10/2002 Catania et al.
6,542,442 B2 4/2003 Kaslon
6,593,142 B2 7/2003 Kelly et al.
6,675,482 B1 1/2004 Gilbert, Jr. et al.
6,850,861 B1 2/2005 Faiola et al.
6,924,147 B2 8/2005 Kelly et al.
6,928,870 B1 8/2005 Liebowitz
7,358,226 B2 4/2008 Dayton et al.
8,229,676 B2 7/2012 Hyde et al.
8,285,488 B2 10/2012 Hyde et al.
8,290,712 B2 10/2012 Hyde et al.
8,299,930 B2 10/2012 Schmid-Schonbein et al.
8,321,141 B2 11/2012 Hyde et al.
8,355,875 B2 1/2013 Hyde et al.
8,386,185 B2 2/2013 Hyde et al.
8,392,123 B2 3/2013 Hyde et al.
8,392,124 B2 3/2013 Hyde et al.
8,392,125 B2 3/2013 Hyde et al.
8,396,672 B2 3/2013 Hyde et al.
8,398,920 B2 3/2013 Hyde et al.
8,439,674 B2 5/2013 Li et al.
2002/0027164 A1 3/2002 Mault et al.
2002/0047867 A1 4/2002 Mault et al.
2002/0104856 A1 8/2002 Clark et al.
2002/0124017 A1 9/2002 Mault
2003/0076983 A1 4/2003 Cox
2004/0158194 A1 8/2004 Wolff et al.
2004/0191313 A1 9/2004 Moest et al.
2005/0184148 A1 8/2005 Perlman
2006/0036395 A1 2/2006 Shaya et al.
2006/0067859 A1 3/2006 Laudamiel-Pellet et al.
2006/0110464 A1* 5/2006 Walls ..... A61K 9/5057 424/490
2007/0028453 A1 2/2007 Crow
2007/0059408 A1 3/2007 Catani et al.
2007/0059409 A1 3/2007 Catani et al.
2007/0098856 A1 5/2007 LePine
2008/0019951 A1 1/2008 Elia
2008/0021327 A1 1/2008 El-Bialy et al.
2008/0069924 A1 3/2008 Zeller et al.
2008/0072432 A1 3/2008 Teys et al.
2008/0147515 A1 6/2008 Abraham et al.
2008/0275117 A1 11/2008 Li et al.
2008/0276461 A1 11/2008 Gold
2009/0095164 A1 4/2009 Celeste
2009/0148483 A1 6/2009 Rashid
2009/0253105 A1 10/2009 Lepine
2009/0285864 A1 11/2009 Godin
2010/0052900 A1 3/2010 Covannon et al.
2010/0109876 A1 5/2010 Schmid-Schonbein et al.
2010/0114819 A1 5/2010 Kim et al.
2010/0240962 A1 9/2010 Contant
2011/0027429 A1* 2/2011 Kogane ..... A47G 19/00 426/132
2011/0125063 A1 5/2011 Shalon et al.
2011/0202553 A1 8/2011 Salemann
2011/0314677 A1* 12/2011 Meier ..... A46B 5/0062 30/41.8
2012/0115111 A1 5/2012 Lepine
2013/0020196 A1 1/2013 Nishiwaki et al.
2013/0273508 A1 10/2013 Hyde et al.
2013/0284821 A1 10/2013 Homer

OTHER PUBLICATIONS

U.S. Appl. No. 13/675,940, Baym et al.
U.S. Appl. No. 13/675,935, Baym et al.
Gilbert, Jason; "HAPIfork: Buzzing Fork Offers Ultimate First-World Solution to Overeating"; Huffington Post; Jan. 8, 2013; 1 page; http://www.huffingtonpost.com/2013/01/08/hapifork-buzzing-fork-solution-overeating_n_2433222.html.
Lewinsohn et al.; "Enhanced Levels of the Aroma and Flavor Compound S-Linalool by Metabolic Engineering of the Terpenoid Pathway in Tomato Fruits"; Plant Physiology; Nov. 2001; pp. 1256-1265; vol. 127, No. 3; American Society of Plant Biologists.
Madene et al.; "Flavour encapsulation and controlled release—a review"; International Journal of Food Science and Technology; 2006; Received Jun. 6, 2004; pp. 1-21; vol. 41; Institute of Food Science and Technology Trust Fund.
Michigan Tehcnological University; "Scents that are sent: oPhone delivers aromas"; Phys.org; Feb. 12, 2014; pp. 1-2; http://phys.org/news/2014-02-scents-ophone-aromas.html.
Nisisako, Takasi; "Microstructured Devices for Preparing Controlled Multiple Emulsions"; Chem. Eng. Technol.; 2008; Received Mar. 3, 2008; pp. 1091-1098; vol. 31, No. 8; Wiley-VCH Verlag GmbH & Co., KGaA, Weinheim.
Piombino et al.; "Saliva from Obese Individuals Suppresses the Release of Aroma Compounds from Wine"; PLOS One; Jan. 2014; pp. 1-11; vol. 9, Issue 1, e85611.
Rovner, Sophie L.; "Food That Smells Too Good to Eat, Enhancing the aroma of food might help dieters eat less"; Chemical & Engineering News; Mar. 15, 2010; pp. 51-52 (4 pages); vol. 88, No. 11; http://pubs.acs.org/doi/abs/10.1021/cen-v088n011.p051.
Ruijschop, et al.; "Retronasal Aroma Release and Satiation: a Review"; Journal of Agricultural and Food Chemistry; 2009; Published on Web Oct. 9, 2009; pp. 9888-9894; vol. 57, No. 21; American Chemical Society.
Shefer et al.; "Novel Encapsulation System Provides Controlled Release of Ingredients"; FoodTechnology; Nov. 2003; pp. 40-42; vol. 57, No. 11.
Starkenmann et al.; "Olfactory Perception of Cysteine—S-Conjugates from Fruits and Vegetables"; Journal of Agricultural and Food Chemistry; 2008; Published on Web Sep. 24, 2008; pp. 9575-9580; vol. 56, No. 20; American Chemical Society.
The Conversation; "Is that a risotto in your pocket? The app that smells like dinner"; Phys.org; Jan. 28, 2014; pp. 1-2; http://phys.org/news/2014-01-risotto-pocket-app-dinner.html.
Utada et al.; "Monodisperse Double Emulsions Generated from a Microcapillary Device"; Science; Apr. 22, 2005; pp. 537-541; vol. 308.
Wikipedia; "Flavor"; Feb. 2, 2014; Printed on Feb. 3, 2014; pp. 1-7; http://en.wikipedia.org/wiki/Flavor.
PCT International Search Report; International App. No. PCT/US2013/069791; Apr. 25, 2014; pp. 1-4.
Skirtach et al.; "Ultrasound stimulated release and catalysis using polyelectrolyte multilayer capsules"; Journal of Materials Chemistry; 2007; pp. 1050-1054; The Royal Society of Chemistry.

(56) References Cited

OTHER PUBLICATIONS

Huff, Ethan A.; "Scientists push to implement edible RFID tracking chips in food" located at http://www.naturalnews.com/032600_RFID_food.html; Jun. 3, 2011; pp. 1-2; Natural News Network (as provided by examiner).

* cited by examiner

FIG. 23

Article of manufacture 2300

One or more non-transitory machine-readable data storage media 2302

One or more instructions for:

controlling with a control signal the release of at least one odorant from at least one controllable odorant emitter carried by an eating utensil, the eating utensil comprising:

an ingestible substance-carrying portion adapted to carry a quantity of an ingestible substance to a mouth of a consumer; and a support portion connected to the ingestible substance-carrying portion and configured to be engaged by a person's hand to permit the ingestible substance-carrying portion to be thereby moved to the mouth of the consumer.

2304

ODORANT-RELEASING UTENSIL

If an Application Data Sheet (ADS) has been filed on the filing date of this application, it is incorporated by reference herein. Any applications claimed on the ADS for priority under 35 U.S.C. §§119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority applications"), if any, listed below (e.g., claims earliest available priority dates for other than provisional patent applications or claims benefits under 35 USC §119(e) for provisional patent applications, for any and all parent, grandparent, great-grandparent, etc. applications of the Priority Application(s)).

PRIORITY APPLICATIONS

The present application constitutes a continuation-in-part of U.S. patent application Ser. No. 13/675,935, entitled ACTIVELY RELEASED FOOD ADDITIVES, naming MICHAEL H. BAYM, RODERICK A. HYDE, JORDIN T. KARE, ERIC C. LEUTHARDT, ELIZABETH A. SWEENEY, AND LOWELL L. WOOD, JR. as inventors, filed 13 Nov. 2012, which is currently co-pending or is an application of which a currently co-pending application is entitled to the benefit of the filing date.

The present application constitutes a continuation-in-part of U.S. patent application Ser. No. 13/675,940, entitled ACTIVELY RELEASED FOOD ADDITIVES, naming MICHAEL H. BAYM, RODERICK A. HYDE, JORDIN T. KARE, ERIC C. LEUTHARDT, ELIZABETH A. SWEENEY, AND LOWELL L. WOOD, JR. as inventors, filed 13 Nov. 2012, which is currently co-pending or is an application of which a currently co-pending application is entitled to the benefit of the filing date.

The present application constitutes a continuation-in-part of United States patent application Ser. No. 13/675,942, entitled ACTIVELY RELEASED FOOD ADDITIVES, naming MICHAEL H. BAYM, RODERICK A. HYDE, JORDIN T. KARE, ERIC C. LEUTHARDT, ELIZABETH A. SWEENEY, AND LOWELL L. WOOD, JR. as inventors, filed 13 Nov. 2012, which is currently co-pending or is an application of which a currently co-pending application is entitled to the benefit of the filing date.

If the listings of applications provided above are inconsistent with the listings provided via an ADS, it is the intent of the Applicant to claim priority to each application that appears in the Domestic Benefit/National Stage Information section of the ADS and to each application that appears in the Priority applications section of this application.

All subject matter of the Priority applications and of any and all applications related to the Priority applications by priority claims (directly or indirectly), including any priority claims made and subject matter incorporated by reference therein as of the filing date of the instant application, is incorporated herein by reference to the extent such subject matter is not inconsistent herewith.

SUMMARY

In an aspect, an eating utensil includes, but is not limited to, an ingestible substance-carrying portion adapted to carry a quantity of a ingestible substance to a mouth of a subject, a support portion connected to the ingestible substance-carrying portion and configured to be engaged by a person's hand to permit the ingestible substance-carrying portion to be thereby moved to the mouth of the subject, and at least one controllable odorant emitter for releasing at least one odorant under control of a control signal. In addition to the foregoing, other system aspects are described in the claims, drawings, and text forming a part of the disclosure set forth herein.

In an aspect, an accessory to an eating utensil includes, but is not limited to, an attachment removably securable to a support portion of the eating utensil, the eating utensil including: an ingestible substance-carrying portion adapted to carry a quantity of a ingestible substance to a mouth of a subject, and the support portion, wherein the support portion is connected to the ingestible substance-carrying portion and configured to be engaged by a person's hand to permit the ingestible substance-carrying portion to be thereby moved to the mouth of the subject, and at least one controllable odorant emitter carried by the attachment and adapted to release at least one odorant in response to a control signal. In addition to the foregoing, other system aspects are described in the claims, drawings, and text forming a part of the disclosure set forth herein.

In an aspect, a method of delivering an odorant in connection with use of an eating utensil for delivering food or drink to a subject, includes, but is not limited to: releasing at least one odorant from at least one controllable odorant emitter carried by an eating utensil in response to a control signal, the eating utensil comprising: an ingestible substance-carrying portion adapted to carry a quantity of an ingestible substance to a mouth of a subject, and a support portion connected to the ingestible substance-carrying portion and configured to be engaged by a person's hand to permit the ingestible substance-carrying portion to be thereby moved to the mouth of the subject. In an aspect, the at least one controllable odorant emitter is a part of the eating utensil. In another aspect, the at least one controllable odorant emitter is a part of an attachment to the eating utensil, wherein the attachment is removably securable to the eating utensil such that when secured to the eating utensil the attachment and parts thereof are carried by the eating utensil. In addition to the foregoing, other method aspects are described in the claims, drawings, and text forming a part of the disclosure set forth herein.

In an aspect, an article of manufacture includes, but is not limited to, one or more non-transitory machine-readable data storage media bearing one or more instructions for controlling the release of at least one odorant from at least one controllable odorant emitter carried by an eating utensil with a control signal, the eating utensil comprising an ingestible substance-carrying portion adapted to carry a quantity of an ingestible substance to a mouth of a subject, and a support portion connected to the ingestible substance-carrying portion and configured to be engaged by a person's hand to permit the ingestible substance-carrying portion to be thereby moved to the mouth of the subject. In addition to the foregoing, other aspects of articles of manufacture including one or more non-transitory machine-readable data storage media bearing one or more instructions are described in the claims, drawings, and text forming a part of the disclosure set forth herein.

In addition to the foregoing, various other method, system and/or article of manufacture aspects are set forth and described in the teachings such as text (e.g., claims and/or detailed description) and/or drawings of the present disclosure.

The foregoing is a summary and thus may contain simplifications, generalizations, inclusions, and/or omissions of detail; consequently, those skilled in the art will appreciate that the summary is illustrative only and is NOT intended to be in any way limiting. Other aspects, features, and advantages of the devices and/or processes and/or other subject matter described herein will become apparent by reference to the detailed description, the corresponding drawings, and/or in the teachings set forth herein.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

FIG. 23 is a schematic block diagram of an article of manufacture including one or more non-transitory machine readable data storage media bearing instructions.

DETAILED DESCRIPTION

Figure 1A:
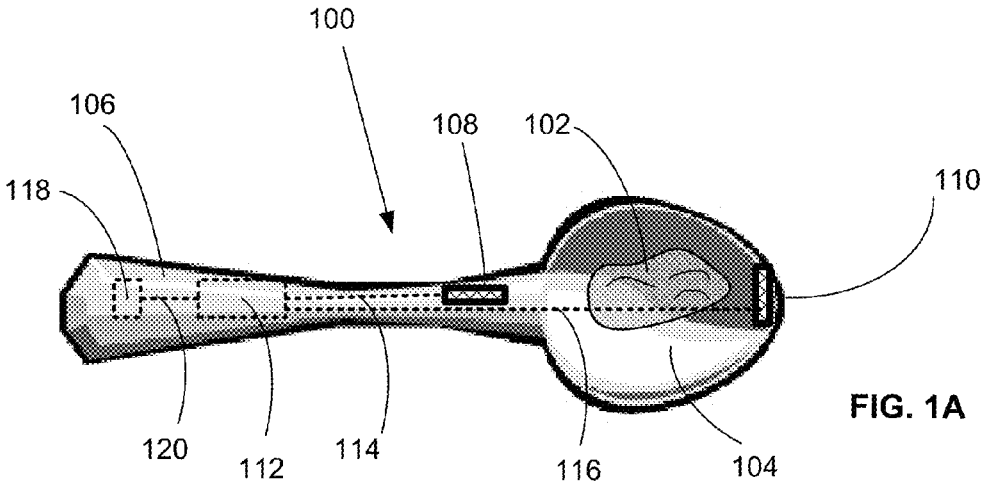
FIG. 1A depicts an embodiment of an eating utensil including odorant emitters.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. The components of the disclosed embodiments, as generally described and illustrated in the figures herein, could be arranged and designed in a wide variety of different configurations. Furthermore, the features, structures, and operations associated with one embodiment may be applicable to or combined with the features, structures, or operations described in conjunction with another embodiment. Dashed lines in the figures are used to indicated optional or alternative components, steps, or processes. Well-known structures, materials, or operations are not shown or described in detail to avoid obscuring aspects of this disclosure. In addition, the steps of a method do not necessarily need to be executed in any specific order, or even sequentially, nor do the steps need to be executed only once.

If a consumer inhales aromas while consuming food or drink, the consumer's perception of the quantity and/or quality of the consumed food or drink can be affected. In some instances, inhaling aromas can satiate a consumer and potentially lower consumption, leading to health benefits if it is desirable for the consumer to consume less, e.g. in order to lose weight. In some instances, inhaling aromas can stimulate appetite to increase food consumption, which may be beneficial in consumers who have decreased appetite due to illness, medication side effect, etc.

Aromas can enter the nasal cavity via two routes. Aromas that are inhaled through the nose enter the nasal cavity via the orthonasal pathway. Aromas are also released into the nasal cavity during the process of chewing and swallowing food and/or drink; the pathway that these aromas follow is called the retronasal pathway. Aroma-producing odorants delivered to the nasal cavity via these two different routes stimulate different regions of the brain. For example, aroma-producing odorants delivered via the orthonasal route activate brain regions associated with the anticipation of eating and desire to consume food. On the other hand, aroma-producing odorants delivered via the retronasal route activate brain regions associated with the sense of reward that comes from eating food, as discussed in Ruijschop et al., "Retronasal Aroma Release and Satiation: a Review", J. Agric. Food Chem., 2009, 57, 9888-9894, which is incorporated herein by reference. The former may cause a person to feel hungry and possibly eat more than necessary while the latter may cause a feeling of satiation and therefore the person may eat less. Aroma-producing odorants entering via either route may modulate or contribute to a consumer's gustatory experience of a food, beverage, or other ingestible substance.

FIG. 1A depicts an eating utensil 100 that can be used to deliver one or more aroma-producing odorants to a consumer in connection with delivery of an ingestible substance 102. Eating utensil 100 include ingestible substance-carrying portion 104, which is adapted to carry a quantity of a ingestible substance 102 to a mouth of a consumer, a support portion 106 connected to the ingestible substance-carrying portion 104 and configured to be engaged by a person's hand to permit the ingestible substance-carrying portion 104 to be thereby moved to the mouth of the consumer, and first and second controllable odorant emitters 108 and 110, respectively, for releasing at least one odorant under control of a control signal. In the example of FIG. 1A, eating utensil 100 is a spoon, ingestible substance-carrying portion 104 is the bowl of the spoon, and support portion 106 is the handle of the spoon. It will be appreciated that support portion 106 (here, the spoon handle) may be configured to be engaged by the hand of the consumer, or by the hand of another person (e.g. if the consumer is a small child being fed by an older person, or any person who is unable to feed themselves, due to lack of muscle strength or coordination, or for any other reason).

As used herein, the term "eating utensil" is used to describe a variety of utensils used to convey ingestible substances to the mouth of a consumer. Ingestible substances may be substantially liquid, or substantially solid, or mixture of liquids and solids (e.g., emulsions, suspensions, etc.) having various consistencies. As is well known, selection of an eating utensil is typical made based upon the consistency of the ingestible substance. For example, a substantially liquid ingestible substance such as a beverage, a soup, a sauce, or a liquid medicine, is commonly conveyed to the mouth of a consumer with a cup, a glass, a spoon, or a drinking straw. Substantially solid ingestible substances may be conveyed to the mouth of a consumer with a fork or chopsticks. A spoon may be used to convey ingestible substances having consistencies ranging from liquid to solid.

Eating utensil 100 in FIG. 1A includes control circuitry 112, which is operatively connected to first controllable odorant emitter 108 via line 114, and to second controllable odorant emitter 110 via line 116. Control circuitry 112 is adapted to generate a control signal for controlling first controllable odorant emitter 108 and second controllable odorant emitter 110. Eating utensil 100 also includes sensor 118, which is operatively connected to the control circuitry 112 via line 120. Control circuitry 112 is configured to generate control signals for controlling first controllable odorant emitter 108 and second controllable odorant emitter 110 based at least in part on receipt of a sense signal from sensor 118.

Figure 1B:
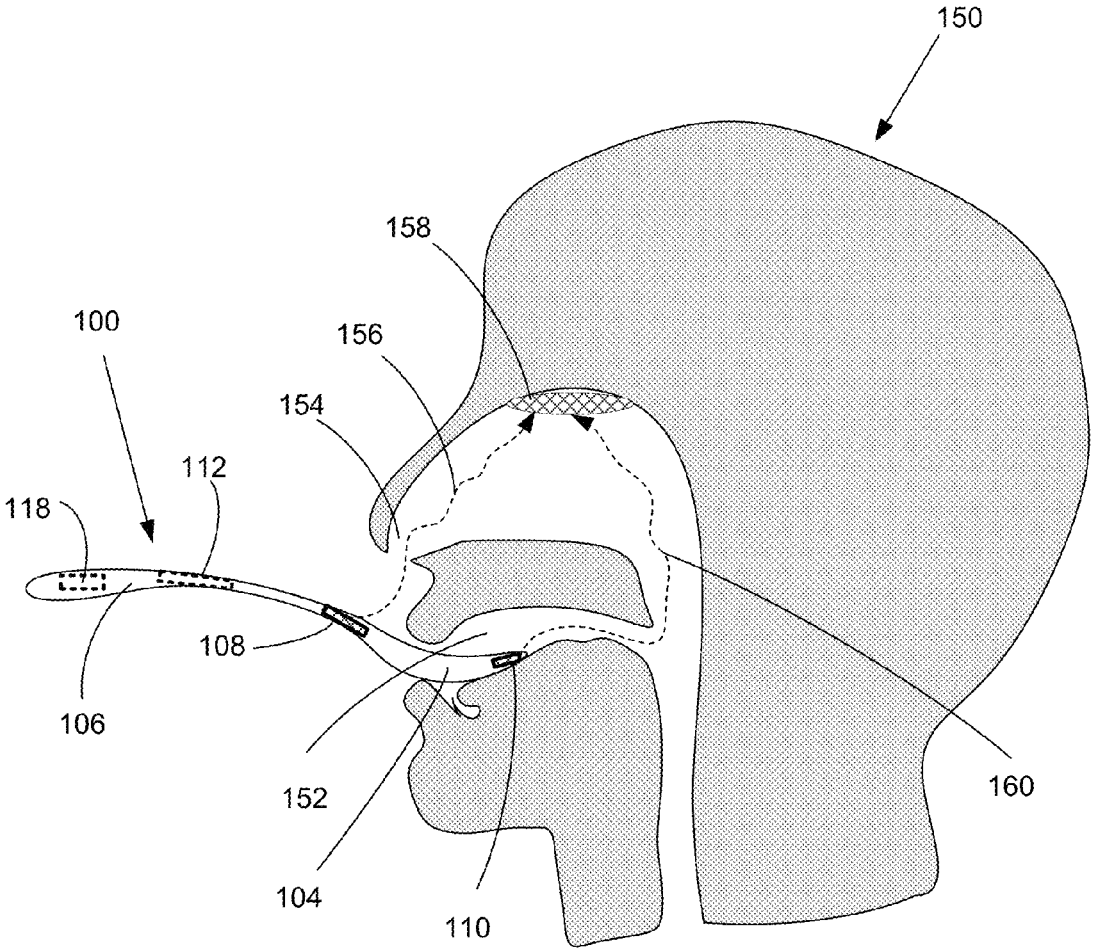
FIG. 1B is an illustration of orthonasal and retronasal delivery of odorants with the eating utensil of FIG. 1A.

FIG. 1B depicts eating utensil 100 in use. Specifically, FIG. 1B depicts a cross-section view of the head of a consumer 150, in which ingestible substance-carrying portion (bowl) 104 of eating utensil 100 is positioned within mouth 152 of consumer 150. A hand of a person (either consumer 150 or another person), not shown in FIG. 1B, engages and supports support portion (handle) 106 to carry eating utensil 100 to mouth 152 of consumer 150. The position of eating utensil 100 relative to the nose and mouth of consumer 150 is detected by sensor 118 in eating utensil 100, which in this example is an accelerometer configured by control circuitry 112. Control circuitry 112 is configured to control the timing of release of odorants from first controllable odorant emitter 108 and second controllable odorant emitter 110 to produce a desired effect on the consumer's appetite. At the start of eating, when ingestible substance-carrying portion 104 of eating utensil 100 is positioned within mouth 152 of consumer 150, an odorant selected to stimulate the consumer's appetite is emitted from first controllable odorant emitter 108 so that it is inhaled via nostril 154 of consumer 150, and travels via orthonasal route 156 to olfactory membrane 158. After consumer 150 has been eating for a selected amount of time (e.g., a time sufficient to consume an appropriate amount of food to attain or maintain a healthy weight), when ingestible substance-carrying portion 104 of eating utensil 100 is positioned within mouth 152 of consumer 150, an odorant selected to inhibit the appetite of consumer 150 is emitted from second controllable odorant emitter 110, so that it travels via retronasal route 160 to olfactory membrane 158.

As shown in FIG. 1B, first controllable odorant emitter 108 is located on the eating utensil such that if the ingestible substance-carrying portion 104 of eating utensil 100 is positioned inside the mouth 152 of consumer 150, odorant emitted from first controllable odorant emitter 108 is delivered orthonasally to consumer 150. Controllable odorant emitter 110 is located on eating utensil 100 such that if ingestible substance-carrying portion 104 of eating utensil 100 is positioned inside the mouth 152 of consumer 150, odorant emitted from second controllable odorant emitter 110 is delivered retronasally to consumer 150. However, it will be appreciated that second controllable odorant emitter 110 is located on eating utensil 100 such that if ingestible substance-carrying portion 104 of eating utensil 100 is approaching the mouth of the consumer 150, odorant emitted from second controllable odorant emitter 110 can be delivered orthonasally to the consumer (not depicted in illustration). Approach of eating utensil 100 to the mouth of consumer 150 can be detected by analysis of the pattern of movement as detected by sensor 118.

As used herein, the term "odorant" may be used to refer to either an aroma-producing odorant or an odorant composition or formulation including one or more odorant and a carrier material. Aroma-producing odorants may comprise esters, linear or cyclic terpenes, aromatic compounds, amines, alcohols, aldehydes, ketones, lactones, thiols, or the like. In some embodiments, the odorant changes the perceived odor, aroma, taste, texture, temperature, and/or color of a food product. In some embodiments, the odorant is a chemical selected to stimulate (or to block) a taste receptor; it may affect sweet, bitter, sour, salty, or umami taste sensations. In some embodiments, the odorant causes a consumer of the food product to be satiated. In some embodiments, a satiety-inducing odorant may comprise an odorant such as isoamyl acetate, aromas indicative of foods such as peppermint, bananas, green apples, sweeteners, or the like. Appetite-inhibiting odorants may induce foul or unpleasing tastes or odors. In other embodiments the odorant may be configured to increase (e.g. to induce and/or stimulate) a consumer's appetite.

In some embodiments, an odorant may be an emulsion or a mixture of multiple odorants. In addition to odorant chemicals, for example, as listed herein above, an odorant may include bacteria, enzymes, or other naturally occurring or synthetic agents. Bacteria that naturally occur in a consumer's mouth and contribute to retroaromas (aromas experienced via the retronasal pathway) can be included with one or more aroma-based flavorings formulated to stimulate retronasal olfaction. See, e.g., Starkenmann et al., "Olfactory Perception of Cysteine—S.—Conjugates from Fruits and Vegetables," J. Agric. Food Chem., Vol. 56, No. 20, 2008, pp. 9575-9580; and Piombina et al., "Saliva from Obese Individuals Suppresses the Release of Aroma Compounds from Wine," PLoS ONE, 9(1):e85611, Doi:10.1371/journal.pone.0085100, Jan. 22, 2014, both of which are incorporated herein by reference. Increased bacteria can lead to a longer lasting effect as the retroaromas tend to linger longer when naturally produced by bacteria in the mouth. Carrier materials used in odorant compositions or formulations may include any materials that improve the stability or other properties of odorants, and may include encapsulating materials, e.g. as described in Madene et al, "Flavour encapsulation and controlled release—a review" *Intl. J. Food Science and Technology,* 2006, 41, 1-21, and Shefer et al., "Novel Encapsulation System Provides Controlled Release of Ingredients," *Food Technology*, November 2003, Vol. 57, No. 11, both of which are incorporated herein by reference.

Figure 2:
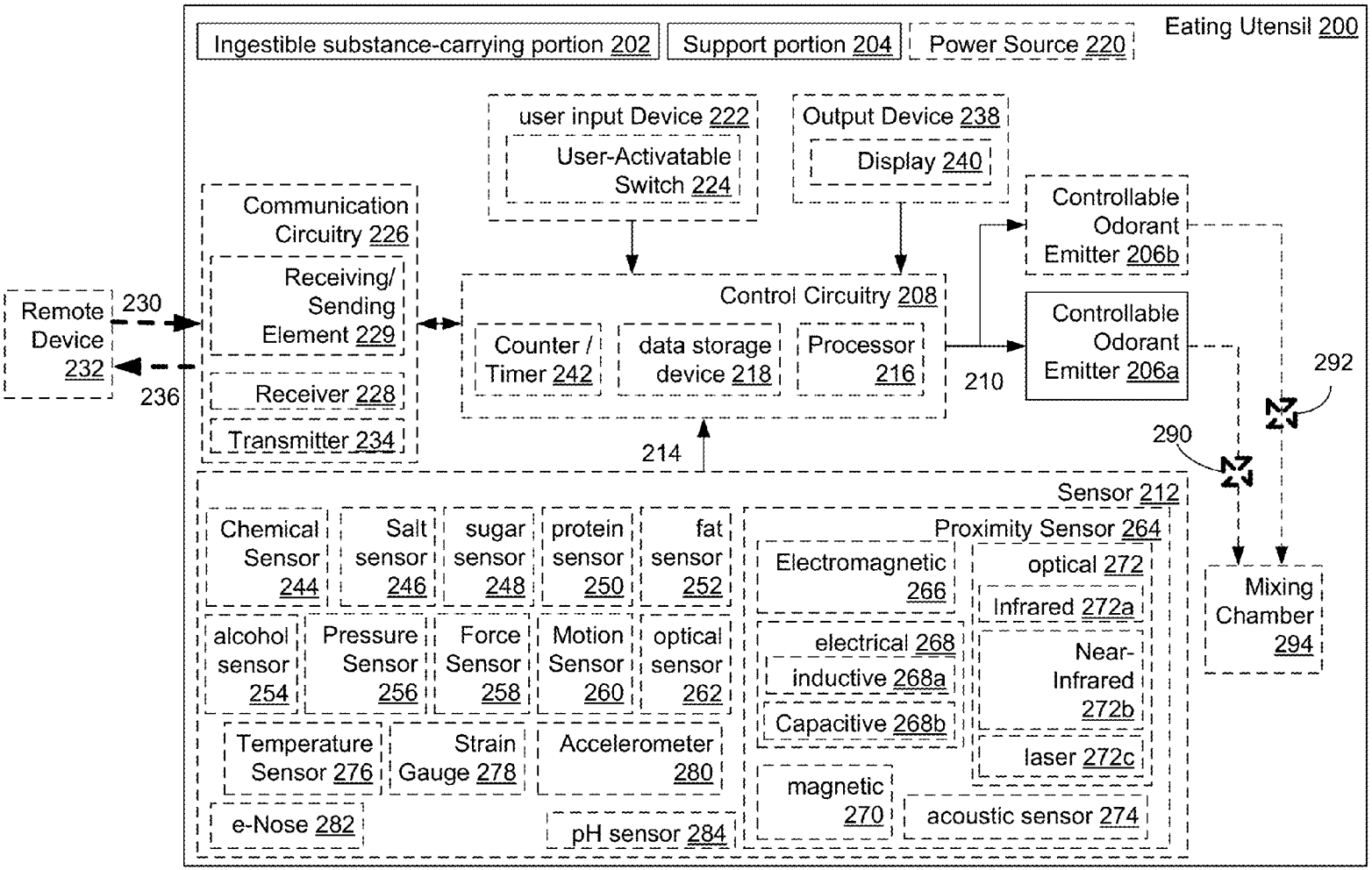
FIG. 2 is a schematic block diagram of an eating utensil.

FIG. 2 is a block diagram illustrating components of an odorant-releasing eating utensil 200, of which eating utensil 100 in FIGS. 1A and 1B is one embodiment. Eating utensil 200 includes ingestible substance-carrying portion 202 adapted to carry a quantity of a ingestible substance to a mouth of a consumer, support portion 204 connected to the ingestible substance-carrying portion 202 and configured to be engaged by a person's hand to permit the ingestible substance-carrying portion 202 to be thereby moved to the mouth of the consumer, and at least one controllable odorant emitter (206*a* and 206*b* in the example of FIG. 2) located on eating utensil 200 for releasing at least one odorant under control of a control signal. In various aspects, eating utensil 200 may be a spoon, a fork, a knife, a spork, a chopstick, a bowl, a plate, a drinking straw, or the like.

In an aspect, the eating utensil 200 includes control circuitry 208 operatively connected to at least one controllable odorant emitter 206*a*/206*b* and adapted to generate control signal 210 for controlling controllable odorant emitter 206*a*/206*b*. In some embodiments, eating utensil 200 includes two or more controllable odorant emitters. A second controllable odorant emitter 206*b* is depicted in FIG. 2, but, it should be understood, larger numbers of controllable odorant emitters may be included, without limitation. Release of odorant from controllable odorant emitters 206*a* and 206*b* may be regulated by gating mechanisms 290 and 292, which may be controlled by control signals from control circuitry 208 (not shown). Gating mechanisms are described in greater detail herein below. Eating utensil 200 may optionally include at least one mixing chamber 294 for mixing at least two odorants released from controllable odorant emitters 206*a* and 206*b* prior to release of the odorant mixture from eating utensil 200. One or more of the odorants released from controllable odorant emitters 206*a* and 206*b* may be aroma-producing materials that produce odors when mixed with one or more other materials; hence mixing of odorants in mixing chamber 294 may produce the actual aroma that will be detected by the consumer. The construction of controllable odorant emitters and release of odorants therefrom is described in greater detail herein below, in connection with FIGS. 4A, 4B, 5A and 5C. Controllable odorant emitters of various types may be used, for example as described in U.S. Pat. No. 6,542,442 to Kaslon and U.S. Pat. No. 6,053,738 to Ivey, Jr., each of which is incorporated herein by reference.

In an aspect, eating utensil 200 includes sensor 212 operatively connected to the control circuitry 208, wherein the control circuitry 208 is configured to generate the control signal 210 based at least in part on receipt of a sense signal 214 from the sensor 212, wherein the sense signal is indicative of a parameter sensed by the sensor. In an aspect, control circuitry 208 is programmable, and may include, for example a processor 216. According to various embodiments, processor 216 may be a microprocessor, microcontroller, logic circuitry, or the like. Processor 216 may include a special purpose processing device such as application-specific integrated circuits (ASIC), programmable array logic (PAL), programmable logic array (PLA), programmable logic device (PLD), field programmable gate array (FPGA), or other customizable and/or programmable device. In some embodiments, the processor 216 may execute instructions which cause controllable odorant emitter 206*a*/206*b* to release one or more odorant, for example. Control circuitry 208 includes data storage device 218, which includes a non-transitory machine-readable data storage medium, which may include non-volatile memory, static RAM, dynamic RAM, ROM, CD-ROM, disk, tape, magnetic, optical, flash memory, or other machine-readable storage medium.

Eating utensil 200 also includes power source 220. In some aspects, power source 220 is a battery or the like (e.g., a fuel cell, a microbattery, or a thin-film battery). The battery may be rechargeable and/or replaceable. In some aspects, power source 220 is an energy harvesting power supply. The energy harvesting power may harvest mechanical energy, for example, when the consumer moves the eating utensil 200 to or from the mouth, or when the consumer bites onto eating utensil 200.

In an aspect, the eating utensil 200 includes a user input device 222. In an aspect, user input device 222 includes a user-activatable switch 224 operatively connected to the at least one controllable odorant emitter 206, wherein the control signal 210 is generated based at least in part on activation of the user-activatable switch.

In an aspect, the eating utensil includes communication circuitry 226. Communication circuitry 226 may include receiver 228, which is operatively connected to the at least one controllable odorant emitter 206*a*, wherein the control signal 210 is generated based at least in part on receipt by receiver 228 of a signal 230 from a remote device 232. In an aspect, control circuitry 208 is configured to generate the control signal 210 based at least in part on receipt by receiver 228 of a signal 230 from remote device 232. Signal 230 may include instructions, programs, or device settings for controlling or managing operation of eating utensil 200.

Communication circuitry also may include transmitter 234 adapted to transmit signal 236 to remote device 232. In an aspect, transmitter 234 is operatively connected to the control circuitry 208 and adapted to transmit at least one of data, instructions or information to a remote device 232, as signal 236. Receiver 228 and transmitter 234 may include electrical circuitry and one or more antenna or other receiving/sending element 229 appropriate for receiving signal 230 and/or sending signal 236, respectively. For example, and without limitation, receiving/sending element 229 may include an antenna for sending/receiving electromagnetic signals, an acoustic transducer for sending/receiving acoustic signals, or an optical source and detector for sending/receiving optical signals. Receiver 228 and transmitter 234 may be constructed as separate devices or constructed as a single transceiver device. In various aspects, remote device 232 includes, for example, at least one of a base station, a cell phone, a communication network, or various other external control or communications devices or systems. For example, data regarding consumption of food, beverages, or medications may be sent to remote device 232 and tracked for medical or health monitoring purposes, and/or for sharing with others via social media, etc. In some embodiments, some control or signal processing functions may be performed on a remote device, and instructions transmitted back to communication circuitry 226 from remote device 232. A remote device may be used as a user interface device for user interaction with the eating utensil 200. Data sent to remote device 232 may include, but is not limited to, raw or unprocessed data, processed data, or data values derived from raw data. Instructions sent to remote device 232 may include, but is not limited to, instructions for operation of eating utensil 200 or instructions to be performed at remote device 232. Information sent to remote device 232 may include, but is not limited to, information regarding hardware and software settings or configurations of eating utensil 200, sensed or stored parameters, instructions, flags, interrupts, programs, variables, or sensed environmental conditions, for example. Data, instructions or information may be transmitted to remote device 232 in real- or near real-time, or stored in data storage device 218 on eating utensil 200 and later sent to remote device 232 in response to a query from remote device 232, in response to an instruction received via user input device 222, or at one or more pre-programmed times.

In some aspects, communication circuitry 226 forms a part of a wireless communication system, such as a Bluetooth™, Wi-Fi, or other radio frequency (RF) communication system, or an optical communication system, such as an infrared or visible spectrum communication system. Other technologies that may be used include ZigBee, local area network (LAN), wireless local area network (WLAN), Body Area Network (BAN), or cellular network. In some embodiments, communication circuitry 226 is a wired communication system. Alternatively, or in addition, communication circuitry 226 may include a physical media device, and physical media may be used to communicate with the eating utensil 200, e.g. by inserting removable physical media such as e.g. optical or magnetic media, memory cards (e.g., Compact Flash card, Secure Digital card, Memory Stick), Zip drives, magnetic tapes, or a single in-line memory module (SIMM) into a slot into eating utensil 200.

In some embodiments, communication circuitry 226 is configured to provide wireless communication between two or more system components of eating utensil 200, e.g., between control circuitry 208, user input device 222, output device 238, communication circuitry 226, sensor 212, and/or controllable odorant emitter(s) 206*a*, 206*b*, for example.

In an aspect, eating utensil 200 includes output device 238 for presenting information relating to the operation of eating utensil 200 to a user of eating utensil 200. Output device 238 may be a display 240, for example, an LED display, an LCD display, a 7-segment display, or other type of display; one or more LED or other light source; an audio speaker, buzzer, bell or other sound generator; or vibration source. In some embodiments output device 238 may be configured to notify the consumer of certain events. For example, output device 238 may notify the consumer that an odorant has been released. Additionally, output device 238 may be used to provide feedback to the consumer in the process of programming or executing an odorant release schedule, as discussed in more detail below. According to various embodiments, the output device 238 may provide feedback to the consumer as haptic vibration, text or images on a display, or audio, for example.

As depicted in FIG. 2, control circuitry 208 is operatively connected to at least one controllable odorant emitter 206*a* (206*b*, etc.) and adapted to generate the control signal 210 for controlling the at least one controllable odorant emitter 206*a* (206*b*, etc.). One or more separate control signals may be sent to each odorant emitter, and although only a single control signal 210 is depicted, any number of control signals may be sent to the one or more controllable odorant emitters to control various aspects of their operation.

In an aspect, eating utensil 200 includes a counter/timer 242 operatively connected to the control circuitry 208. Control circuitry 208 can be configured to determine a number of times the eating utensil is moved to the mouth of the consumer, e.g. by using counter/timer 242 to count cycles of movement of eating utensil 200 as detected by sensor 212. Alternatively or in addition, control circuitry 208 can be configured to determine a duration of use of eating utensil, e.g. by initiating counter/timer 242 to begin counting when use of eating utensil 200 is commenced. Configuration of control circuitry 208 can be accomplished with hardware or software, and depending on the embodiment may be done during manufacture of the device or, in some cases, during use of the device by the consumer or other user.

In an aspect, eating utensil 200 includes a user-activatable switch 224 operatively connected to control circuitry 208, wherein control circuitry 208 is configured to generate control signal 210 based at least in part on activation of user-activatable switch 224. For example, a user (e.g. the consumer, or someone who is assisting the consumer with eating) may depress a user-activatable switch 224 to indicate the start of eating and to initiate a pre-programmed pattern of odorant release.

In an aspect, eating utensil 200 includes sensor 212 operatively connected to control circuitry 208, wherein control circuitry 208 is configured to generate control signal 210 based at least in part on receipt of a sense signal 214 from the sensor 212.

Figure 5A:
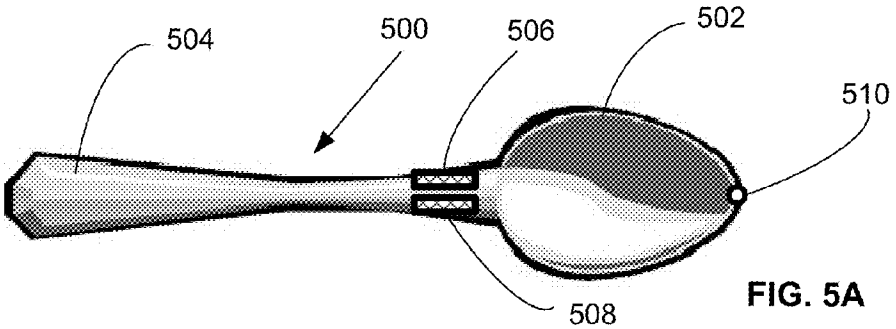
FIG. 5A depicts an embodiment of an eating utensil including odorant emitters.

Sensor 212 may be located on the ingestible substance-carrying portion 202 of the eating utensil 200 (e.g., as depicted in FIG. 5A) or on the support portion 204 of the eating utensil 200 (e.g. like sensor 118 depicted in FIGS. 1A and 1B).

In an aspect, sensor 212 includes a chemical sensor 244, which may include, for example, a salt sensor 246, a sugar sensor 248, a protein sensor 250, a fat sensor 252, or an alcohol sensor 254. In an aspect, sensor 212 includes a pressure sensor 256, a force sensor 258, a motion sensor 260, an optical sensor 262, or a proximity sensor 264. A proximity sensor can include an electromagnetic sensor 266, an electrical sensor 268 (e.g., inductive sensor 268*a* or capacitive sensor 268*b*), a magnetic sensor 270, an optical sensor 272 (e.g., an infrared sensor 272*a*, near-infrared sensor 272*b*, or laser sensor 272*c*), or an acoustic sensor 274. A proximity sensor can sense proximity of the utensil to a skin surface, for example. In various aspects, sensor 212 includes a temperature sensor 276, a strain gauge 278, an accelerometer 280, an e-Nose 282, or a pH sensor 284.

Eating utensil 200 may include one or multiple sensors. Multiple sensors of the same type may be used to provide redundancy, or several different types of sensors may be used to sense several different parameters.

In an aspect, the sensor 212 is adapted to sense a parameter indicative of a weight of an ingestible substance carried by the ingestible substance-carrying portion. For example, weight of ingestible substance may be determined by an appropriately configured pressure sensor, force sensor, strain gauge, or accelerometer, for example. In an aspect, the sensor 212 is adapted to sense a parameter indicative of at least a portion of the ingestible substance-carrying portion being inside the mouth of the consumer. For example, one or more of an optical sensor (e.g., a photosensor), temperature sensor, e-nose, or capacitive sensor can be used to detect that the ingestible substance-carrying portion is inside the mouth of the consumer. In some aspects, sensor 212 may be configured to determine contact of a portion of eating utensil 200 with a surface of the consumer's mouth. For example, in one embodiment, the sensor 212 may be a capacitive sensor, a pressure sensor, or the like configured to detect contact with the consumer's mouth. The sensor 212 may be configured to determine contact with the consumer's tongue, lip, tooth, or another interior surface of the consumer's mouth, for example. In other aspects a moisture sensor or a protein sensor for detecting, e.g. mucin or mucus, may be used to detect contact with the consumer's mouth.

In an aspect, the sensor 212 is a proximity sensor 264 adapted to sense a parameter indicative of at least a portion of the ingestible substance-carrying portion being in the vicinity of a skin region of the consumer. Proximity sensor 264 may include, but is not limited to, an electromagnetic sensor, an electrical sensor (e.g., an inductive or capacitive sensor), a magnetic sensor, an optical sensor (e.g. an infrared, near-infrared, or laser sensor), or an acoustic sensor.

In an aspect, the sensor is adapted to sense a parameter indicative of a component of an ingestible substance carried by the ingestible substance-carrying portion, e.g. by sensing a chemical component or a pH of the ingestible substance. In an aspect, the sensor is adapted to sense a parameter indicative of movement of the eating utensil toward or away from the mouth of the consumer, e.g. by sensing acceleration with an accelerometer, amplitude of a reflected signal with an optical or acoustic sensor, or with the use of an image sensor. A variety of sensors for detecting chemical components of foods or beverages are described in U.S. Pat. No. 8,229,676 issued Jul. 24, 2012 to Hyde et al., and U.S. Pat. No. 8,398,920 issued Mar. 19, 2013 to Hyde et al., both of which are incorporated herein by reference. Biosensors for detecting components including caffeine, alcohol, formaldehyde, monosodium glutamate, sulfites, and nitrates in foodstuffs are described in U.S. Pat. No. 5,824,554 to McKay, which is incorporated herein by reference. An example of monitoring sodium content of a foodstuff is found in U.S. Pat. No. 4,918,391 to Byrd, which is incorporated herein by reference. Another example of detecting caffeine content of a foodstuff may be found in U.S. Pat. No. 6,461,873, to Catania et al., which is incorporated herein by reference. Sensors for detecting compounds indicative of food spoilage are described in U.S. Pat. No. 6,593,142 to Kelly et al., and U.S. Pat. No. 6,924,147 to Kelly et al., which are incorporated herein by reference.

In one embodiment, the eating utensil or oral implant may use an ultrasonic transducer to determine proximity to a portion of the body of the consumer.

According to various embodiments, the sensor 212 may be used in combination with a counter/timer 242 to determine the number of times a certain action has been performed by the consumer. For example, counter/timer 242 may be configured to count the number of times the consumer has placed eating utensil 200 in the consumer's mouth. In other aspects control circuitry 208 may be configured by software to track events relating to use of eating utensil 200. Movement of eating utensil 200 as it is brought to the mouth of the consumer may be detected, for example, through use of a motion sensor including an accelerometer or gyroscope, for example (see, e.g. U.S. Published Patent Application 2012/0115111 published May 10, 2012, to Lepine, which is incorporated herein by reference), or by various other time-varying sensed signals that indicate use of the eating utensil.

Figure 3A:
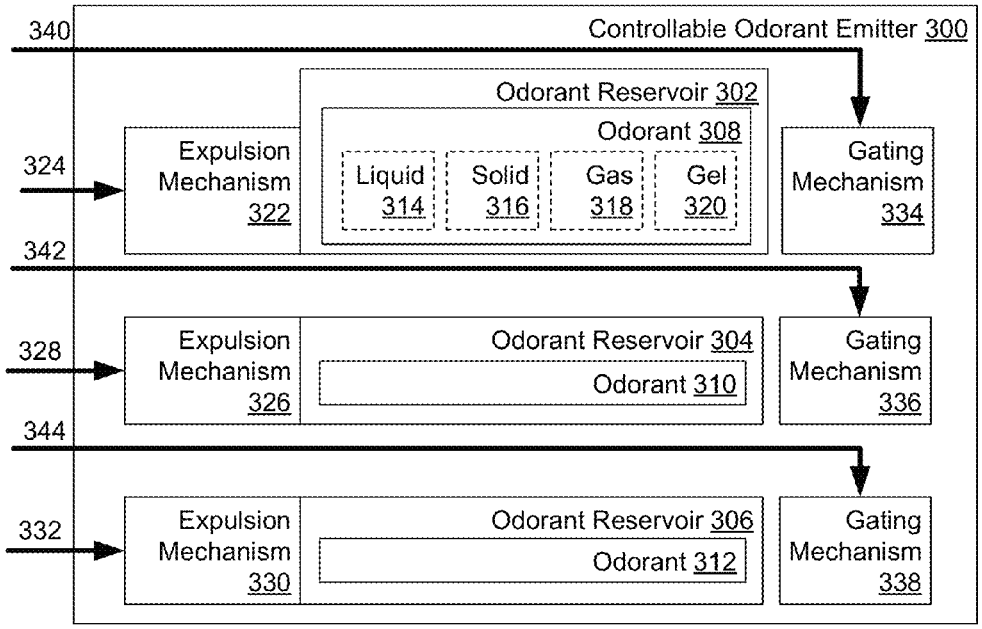
FIG. 3A depicts an embodiment of a controllable odorant emitter.
Figure 3B:
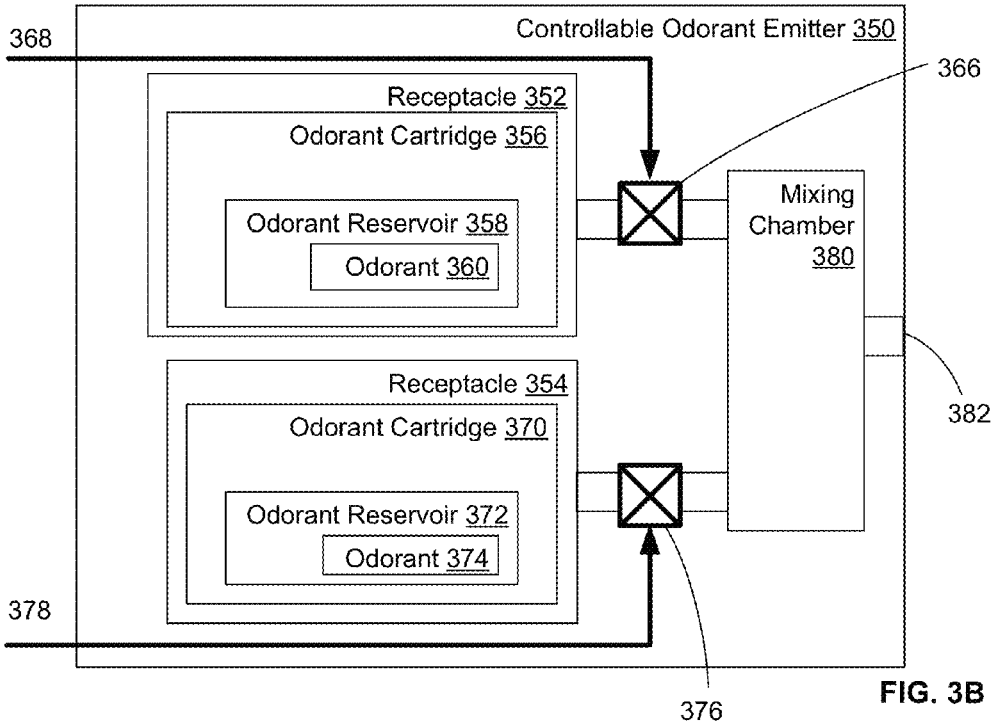
FIG. 3B depicts an embodiment of a controllable odorant emitter.

FIGS. 3A and 3B depict several examples for construction of controllable odorant emitters, e.g. such as controllable odorant emitter 206*a* and 206*b* in FIG. 2. In some aspects, a controllable odorant emitter can include a single odorant reservoir. In other aspects, a controllable odorant emitter includes at least two refillable reservoirs adapted for containing odorant. For example, FIG. 3A depicts controllable odorant emitter 300, which includes odorant reservoirs 302, 304, and 306, containing odorants 308, 310, and 312, respectively. Odorant 308 may be a liquid odorant 314, a solid odorant 316, a gaseous odorant 318 or a gel odorant 320. Similarly, odorants 310 and 312 may be liquid, solid, gas, or gel, although this is not depicted in FIG. 3A. As noted herein above, an odorant can include an odorant molecule by itself, or an odorant formulation that contains one or more odorant molecules and carrier or binder materials. Odorants can take various forms (liquid, solid, gas, gel) depending not only on the odorant molecule but also the carrier or binder material, if used. In FIG. 3A, odorant 308 is released from odorant reservoir 302 driven by expulsion mechanism 322, which is controlled by a control signal 324. Similarly, odorant 310 is released from odorant reservoir 304 driven by expulsion mechanism 326, which is controlled by a control signal 328, and odorant 312 is released from odorant reservoir 306 driven by expulsion mechanism 330, which is controlled by a control signal 332. Gating mechanisms 334, 336, and 338 prevent or permit release of odorant from odorant reservoirs 302, 304, and 306, respectively. Control signals 340, 342, and 344 for controlling gating mechanisms 334, 336, and 338, respectively, as well as control signals 324, 328, and 332, are generated by control circuitry, e.g. control circuitry 208 in FIG. 2, and are aspects of control signal 210 in FIG. 2. Operation and examples of expulsion mechanisms and gating mechanisms are described further in connection with FIGS. 4A and 4B. Different odorant reservoirs 302, 304 and 306 may contain different odorants, which during use of the eating utensil may be released at different times and/or different locations to influence the consumer's appetite in different ways, or to produce different sensory experiences, for example. Alternatively, some or all of odorant reservoirs 302, 304 and 306 may contain the same odorant, in order to provide a particular odorant in a larger amount at a particular time, or to have a longer-lasting supply of odorant than would be possible with a single odorant reservoir.

FIG. 3B depicts a controllable odorant emitter 350 including receptacles 352 and 354, each adapted for receiving at least one removable cartridge containing the at least one odorant. Receptacle 352 receives odorant cartridge 356, which contains odorant reservoir 358 containing odorant 360, and receptacle 354 receives odorant cartridge 370, which includes odorant reservoir 372, containing odorant 374. In some embodiments (not shown) at least one receptacle may be adapted for receiving at least two removable cartridges, each of the cartridges containing at least one odorant. In some embodiments, removable cartridges may contain at least two odorants (e.g. in separate reservoirs within the cartridge). A cartridge may include a substantially rigid housing (formed, e.g. from plastic, metal, or ceramic), or a cartridge may include a pouch (formed, for example, from a pliable polymeric or metallic membrane) filled with at least one of a gas, liquid, solid, or gel.

Odorant reservoirs formed directly in a controllable odorant emitter (as in FIG. 3A) or in a cartridge (as in FIG. 3B) may be refillable, or adapted for a single use. A reservoir may be an open structure covered by a membrane that retains the odorant within the reservoir. For example, the membrane may be configured to release the odorant when exposed to energy from an activation source that breaks, disintegrates, or melts the membrane. In one such embodiment, the membrane may have an acoustic resonance matching an acoustic frequency emitted by the activation source. In another embodiment, the membrane may include a material having a resonance that matches an electromagnetic frequency emitted by the activation source. In some embodiments the odorant may be stored in the reservoir under pressure. In such embodiments, the odorant may be more widely distributed when it is released from the reservoir based on the pressure difference.

An eating utensil may include at least one mixing chamber for mixing at least two odorants. The mixing chamber may be in the eating utensil, as depicted in FIG. 2, or in the controllable odorant emitter, as depicted in FIG. 3B (see mixing chamber 380, which receives odorant 360 from odorant reservoir 358 in odorant cartridge 356 and odorant 374 from odorant reservoir 372 in odorant cartridge 370). Flow of odorant from the two cartridges is regulated by valves 366 and 376, controlled by control signals 368 and 378, respectively, which are generated by control circuitry such as control circuitry 208 in FIG. 2. Following mixing in mixing chamber 380, the resulting odorant mixture is released via outlet 382.

Figure 4D:
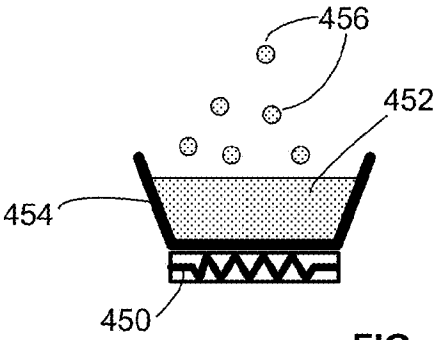
FIG. 4D depicts an expulsion mechanism.
Figure 4E:
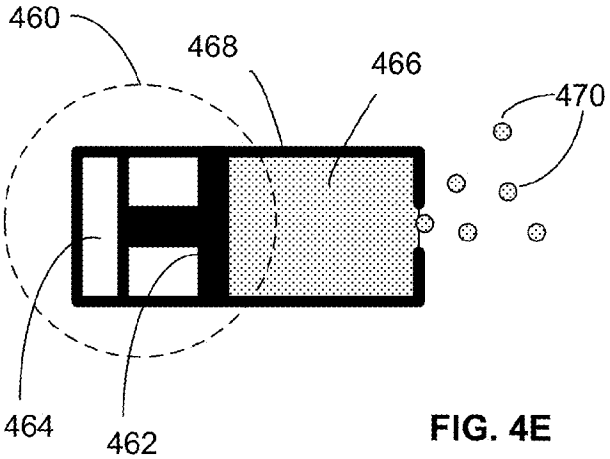
FIG. 4E depicts an expulsion mechanism.
Figure 4A:
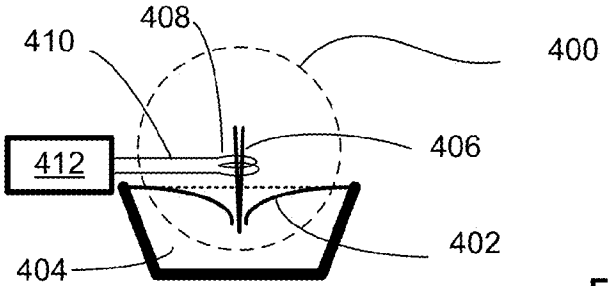
FIG. 4A depicts a gating mechanism.
Figure 4B:
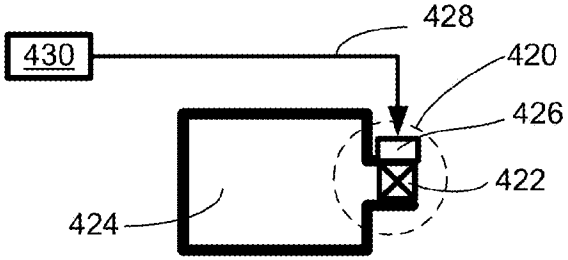
FIG. 4B depicts a gating mechanism.
Figure 4C:
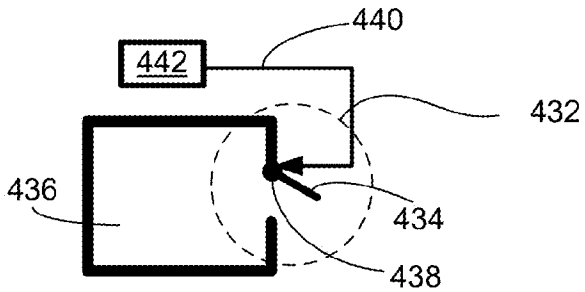
FIG. 4C depicts a gating mechanism.

FIGS. 4A-4C depict in schematic form several embodiments of a gating mechanism which is a component of a controllable odorant emitter (not shown) used to regulate the release of odorant from a reservoir in the controllable odorant emitter. For example, FIG. 4A depicts gating mechanism 400 including at least one puncturable membrane 402 over the opening of reservoir 404 and at least one controllable puncture mechanism, which may be, for example, a pin or rod 406 controlled by a solenoid 408 driven by a current control signal 410 from source 412. U.S. Pat. No. 6,542,442 to Kaslon, which is incorporated herein by reference, describes a scent cartridge sealed by a penetrable resealing membrane, from which a scent is released by penetration of the membrane by a needle. Such a mechanism may be used herein. As another example, FIG. 4B depicts gating mechanism 420 which includes valve 422 at the outlet of reservoir 424 and valve actuation mechanism 426, for example an electroactive mechanism driven by control signal 428 from source 430. In an aspect, as shown in FIG. 4C, the at least one gating mechanism 432 includes at least one gate 434 at the outlet of reservoir 436. In general, a gate may be any type of controllable barrier that, when closed, prevents the release of odorant from a reservoir, and that, when opened, permits the release of odorant from the reservoir. In an aspect, the at least one gating mechanism includes at least one gate actuation mechanism 438, controlled by control signal 440 from source 442. For use in an eating utensil, control signals 410, 428 and 440 produced by sources 412, 430, and 442, respectively, can be produced by control circuitry 208, as depicted in FIG. 2.

While in some cases odorants may exit the reservoir in which they are contained immediately and spontaneously upon opening of a valve, gate, or other barrier (e.g., a puncturable membrane), in other cases the controllable odorant emitter may include at least one expulsion mechanism that serves to expel the odorant from the reservoir. FIGS. 4D and 4E depicts in schematic form examples of expulsion mechanisms. As shown in FIG. 4D, an expulsion mechanism may include, for example, at least one heating mechanism 450 (such as a thermoelectric element), which causes expulsion of the odorant 452 from the reservoir 454 by causing expansion and/or volatilization of the odorant so that it moves out of the reservoir. For example, U.S. Published patent application 2009/0148483 to Rashid, which is incorporated herein by reference, describes the release of "olfactories" (e.g. fragrances) through heating. Volatilized odorant is indicated at 456. Applying heat (or other energy, such as acoustic or other vibrational energy, or light or other electromagnetic energy, may be used to cause release of odorants from encapsulants as well as to produce expansing and/or volatilization. As indicated in FIG. 4E, an expulsion mechanism may include at least one propulsion mechanism 460, e.g. a plunger 462 driven by actuator 464, that serves to push or propel the odorant 466 out of reservoir 468. Other propulsion mechanisms include, for example, a striker, an ejector or a spring. Odorant that has been expelled from reservoir 468 is indicated by 470.

FIG. 5A depicts an eating utensil 500 which is configured as a spoon, where the ingestible substance-carrying portion 502 includes a bowl of the spoon, and the support portion 504 is a spoon handle. Eating utensil 500 includes two controllable odorant emitters 506 and 508, located in the spoon handle. Eating utensil 500 also includes optical sensor 510 for detecting when ingestible substance-carrying portion 502 is placed inside the mouth of a consumer. Control circuitry on eating utensil 500 (not shown) controls the release of two different odorants from controllable odorant emitters 506 and 508; for example, an odorant that enhances the flavor of the consumed food is released at the start of eating by controllable odorant emitter 506, and, after an appropriate quantity of food has been consumed, an appetite inhibiting odorant is released from controllable odorant emitter 508 to discourage further consumption of food.

Figure 5B:
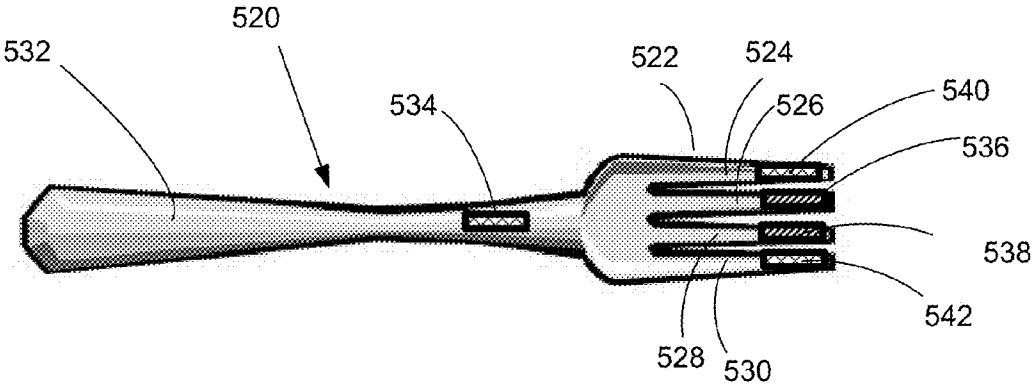
FIG. 5B depicts an embodiment of an eating utensil including odorant emitters.

FIG. 5B depicts an eating utensil 520 configured as a fork. In this embodiment, the ingestible substance-carrying portion 522 includes one or more tines 524, 526, 528, and 530 of the fork, and the support portion 532 is a fork handle. Controllable odorant emitter 534 is located in the fork handle. Controllable odorant emitters 536 and 538 are located at adjacent locations on tines 526 and 528, respectively, spatially separated with respect to controllable odorant emitter 534. Sensors 540 and 542, located on tines 524 and 530, respectively, are chemical sensors (e.g., as described herein above) for sensing a component of an ingestible substance carried by the fork. Sensors 540 and 542 are redundant to improve the probability of reliably sensing the component of the ingestible substance and to reduce the dependence of sensing on the position of the ingestible substance on the fork. Release of odorants from controllable odorant emitters 534, 536, and 538 is performed under the control of control circuitry (not shown) on eating utensil 520, based at least in part on detection of signals from one or both of sensors 540 and 542.

Figure 5C:
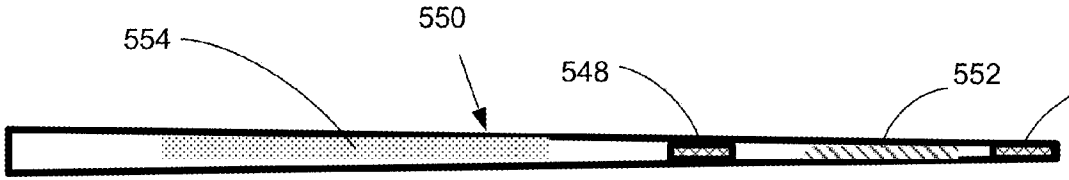
FIG. 5C depicts an embodiment of an eating utensil including an odorant emitter.

FIG. 5C depicts an eating utensil 550 configured as a chopstick, where the ingestible substance-carrying portion 552 includes a first end region of a chopstick, and wherein the support portion 554 includes a second end region of the chopstick. An electrical proximity sensor 546 is located at the first end region of the chopstick, and controllable odorant emitter 548 is located intermediate between the first end region and the second end region of eating utensil 550, such that odorant can be delivered orthonasally to the consumer during eating.

Figure 6B:
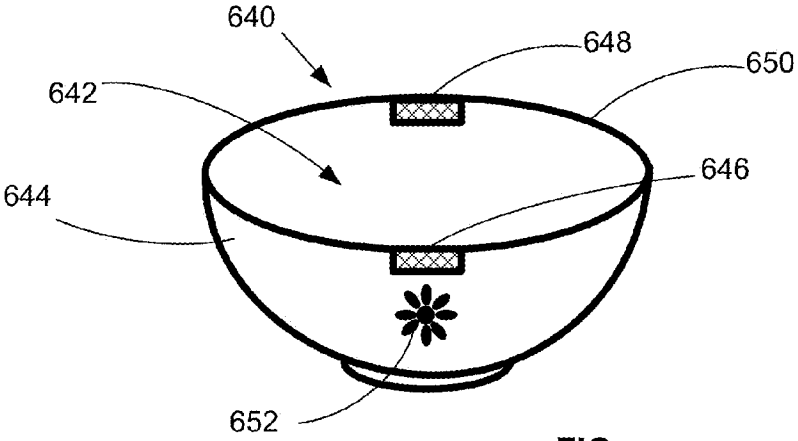
FIG. 6B is an illustration of an eating utensil including odorant emitters.
Figure 6C:
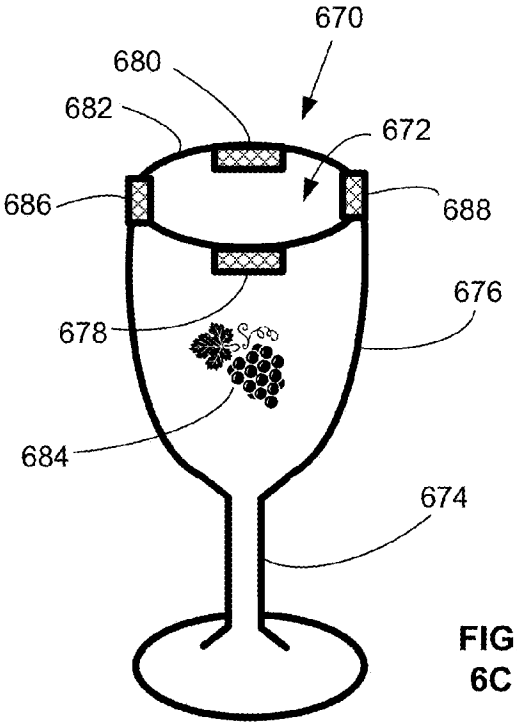
FIG. 6C is an illustration of an eating utensil including odorant emitters.
Figure 6A:
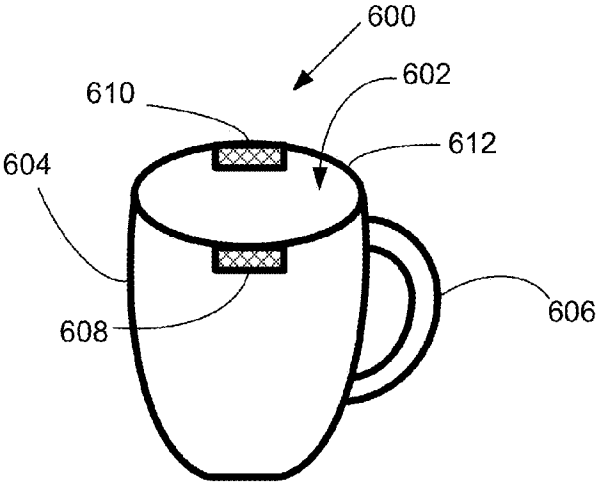
FIG. 6A is an illustration of an eating utensil including odorant emitters.

As noted herein above, in some embodiments, eating utensils as described herein are adapted for use with liquid or semi-liquid ingestible substances. FIGS. 6A-6C depict several such eating utensils. Control circuitry is not depicted in FIGS. 6A-6C, but it should be understood that control circuitry for controlling the release of odorants from the controllable odorant emitters would be included in these eating utensils.

FIG. 6A depicts an eating utensil 600 configured as a cup, wherein the ingestible substance-carrying portion includes an interior concavity 602 of the cup. In an aspect, the support portion includes an exterior surface 604 of the cup. In another aspect, the support portion includes a handle 606 of the cup. Controllable odorant emitters 608 and 610 are located on rim 612 of eating utensil 600. If the consumer is right-handed and picks up the cup by handle 606, during use, controllable odorant emitter 608 will be positioned to deliver an odorant retronasally, and controllable odorant emitter 610 will be positioned to deliver odorant orthonasally. Whether one or the other of controllable odorant emitters 608 and 610 is located within the consumer's mouth during drinking of liquid from the cup will depend on whether the consumer picks up the cup by handle 606, or by grasping exterior surface 604, and also on whether the consumer is right or left handed. It may be necessary for the consumer to pay attention to proper orientation of the cup during drinking. By providing sensors to detect the orientation of eating utensil 600 with respect to the consumer's mouth (e.g., proximity sensors or level sensors) and additional controllable odorant emitters (not shown) on rim 612 of eating utensil 600, controllable odorant emitters could be activated selectively to deliver odorant either orthonasally or retronasally, as desired.

FIG. 6B depicts an eating utensil 640 configured as a bowl, where the ingestible substance-carrying portion includes an interior concavity 642 of the bowl, and wherein the support portion includes an exterior surface 644 of the bowl. Eating utensil 640 includes controllable odorant emitter 646 and controllable odorant emitter 648 located in rim 650 of the bowl. It is presumed that, in use, eating utensil 640 is raised close enough to the consumer's face that the consumer is able to inhale the aroma produced by the controllable odorant emitter(s) on the bowl (orthonasally). This may occur if the rim 650 of the bowl is placed at the consumer's lips so that liquid can be sipped or drunk from the bowl, or if the bowl is placed near the consumer's mouth so that solid food (e.g. noodles or rice) can be easily consumed with the use of an additional eating utensil such as a spoon, fork, or chopsticks. If the rim of the bowl is placed at the consumer's lips, then aroma produced by a controllable odorant emitter located on the rim within the consumer's mouth can release an odorant for retronasal delivery to the consumer. To aid in positioning of controllable odorant emitters 646 and 648 with respect to the consumer's mouth, a decorative pattern 652 is positioned with respect to at least one controllable odorant emitter 646. By orienting decorative pattern 652 correctly with respect to his or her mouth, the consumer ensures proper placement of control odorant emitters 646 and 648. As an alternative to decorative pattern 652, a light or other indicator controlled by circuitry can be used to inform the consumer whether the eating utensil is properly oriented.

FIG. 6C depicts an eating utensil 670 configured as a stemmed glass, wherein the ingestible substance-carrying portion includes an interior concavity 672 of the glass, and wherein the support portion includes a stem 674 of the glass (and/or exterior surface 676 of the bowl of the glass). Controllable odorant emitters 678 and 680 are located on rim 682 of eating utensil 670. A decorative pattern 684 is provided to aid in orientation of the controllable odorant emitters 678 and 680 properly with respect to the mouth and/or nose of the consumer. Additional controllable odorant emitters 686 and 688 are also provided, and can be selectively activated depending on the position of the glass with respect to the mouth and nose of the consumer.

Figure 7:
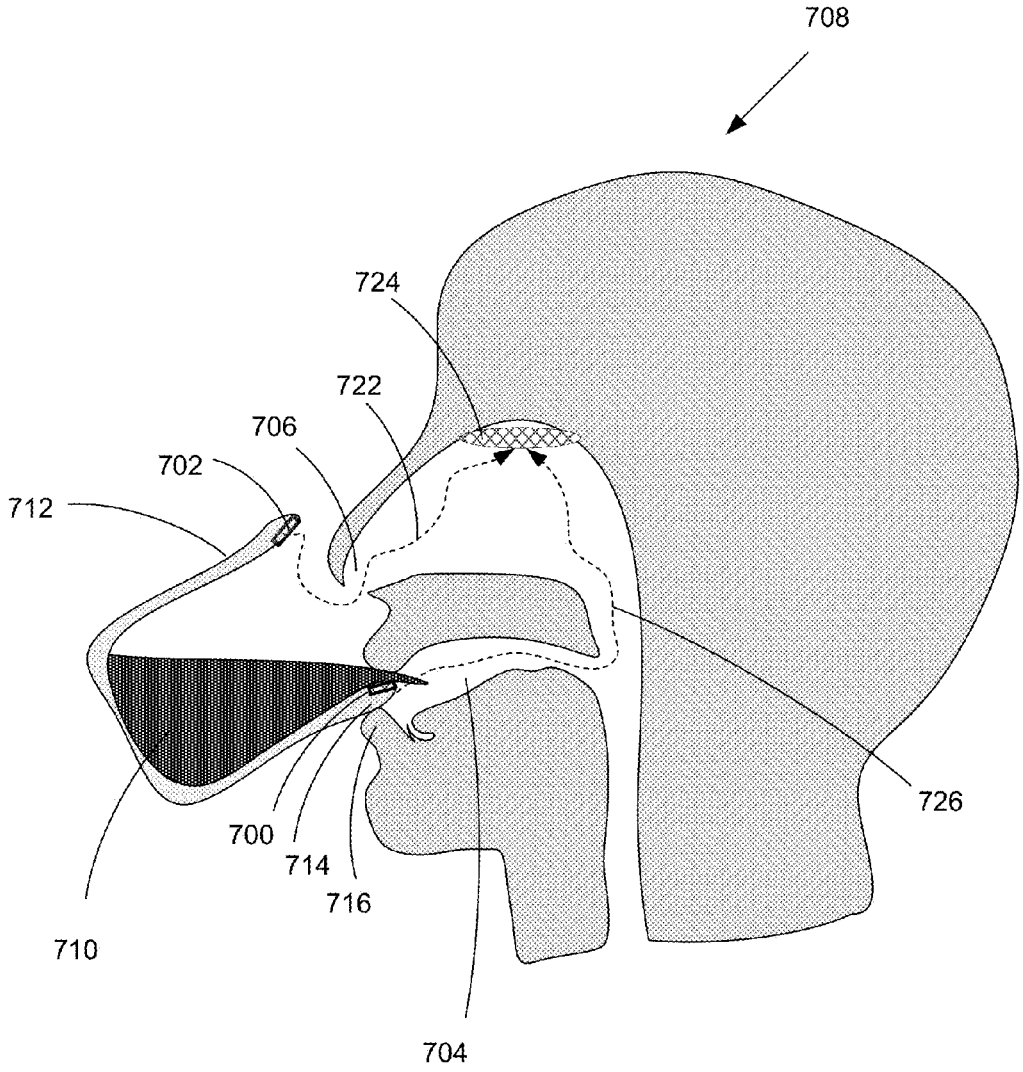
FIG. 7 is an illustration of orthonasal and retronasal delivery of odorants with an eating utensil.

FIG. 7 depicts positioning of controllable odorant emitters 700 and 702 with respect to the mouth 704 and nostril 706 of consumer 708 during drinking of liquid 710 from glass 712. During use, rim 714 of glass 712 rests against lower lip 716 of consumer 708. Odorant released from controllable odorant emitter 702 as consumer 708 drinks from glass 712 may travel via orthonasal route 722 to olfactory membrane 724 of consumer 708. Odorant released from controllable odorant emitter 700 as consumer 708 drinks will travel via retronasal route 726 to olfactory membrane 724. While FIG. 7 depicts a glass 712 having a basic shape, it will be appreciated that the principles described in connection with FIG. 7 apply to consumption of liquids from various types of cups, mugs, glasses, etc.

While FIGS. 1A, 1B, 2, 5A-5C, 6A-6C, and 7 depict embodiments of eating utensils that include built-in odorant emitters and associated sensors and control circuitry, similar functionality may be provided through the use of an odorant-releasing attachment that can be secured to an eating utensil. Such an attachment can be used with conventional eating utensils, for example, so that the consumer does not need to bring an eating utensil along if he or she goes to a restaurant. Such an attachment can be removed from the utensil prior to washing of the utensil, to avoid exposure of sensitive (e.g., electronic) components of the attachment to water and/or detergent.

Figure 8:
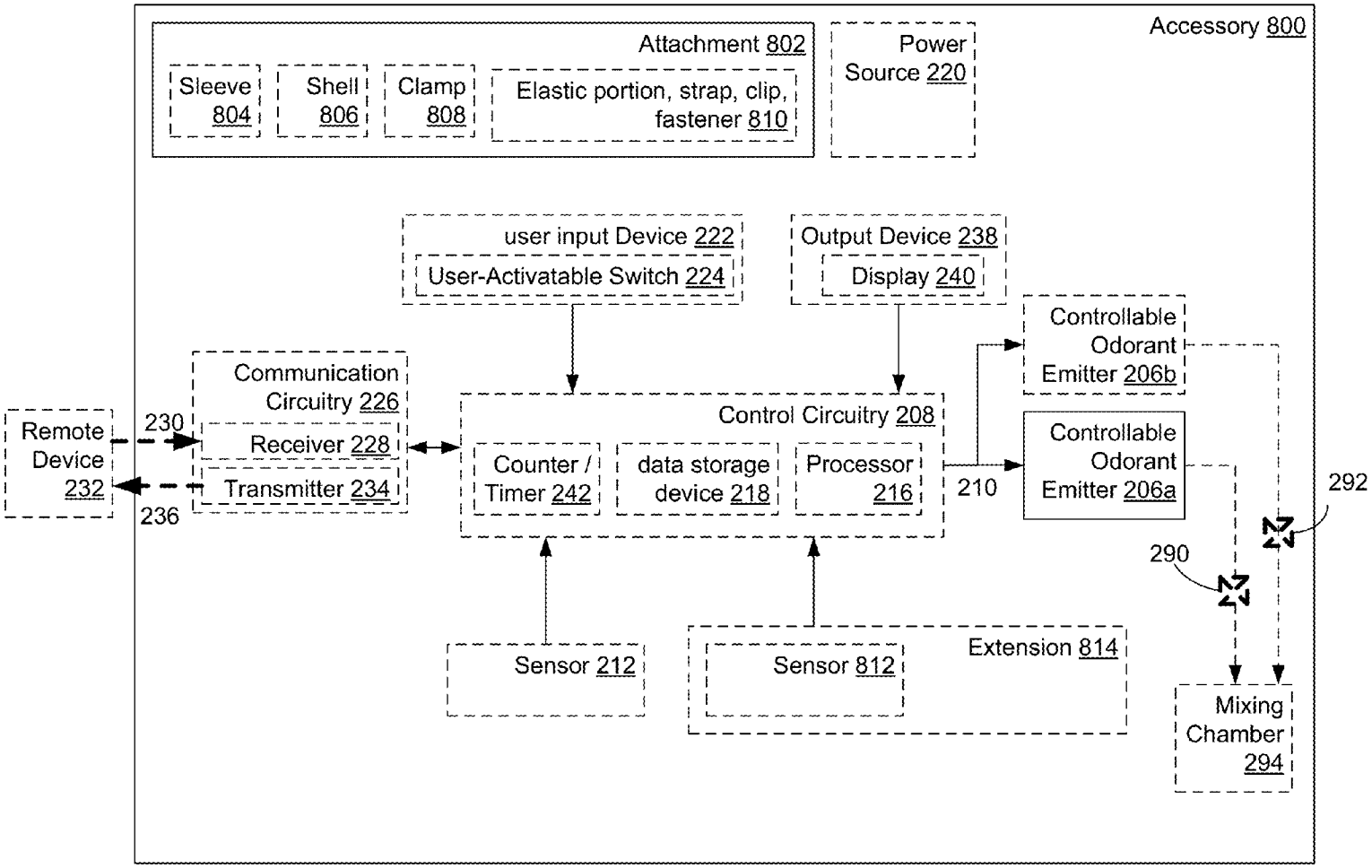
FIG. 8 is a block diagram of an accessory to an eating utensil.

FIG. 8 is a block diagram of an accessory to an eating utensil. As described generally herein above, the eating utensil (which is not shown in FIG. 8, but can be any of the various types of eating utensils described elsewhere herein) includes an ingestible substance-carrying portion adapted to carry a quantity of a ingestible substance to a mouth of a consumer, and the support portion, wherein the support portion is connected to the ingestible substance-carrying portion and configured to be engaged by a person's hand to permit the ingestible substance-carrying portion to be thereby moved to the mouth of the consumer. Accessory 800 includes attachment 802, which is removably securable to a support portion of the eating utensil. Attachment 802 includes at least one controllable odorant emitter (in FIG. 8, two controllable odorant emitters 206*a* and 206*b* are depicted) carried by attachment 802 and adapted to release at least one odorant in response to a control signal 210, which is described by control circuitry 208 on accessory 800. Elements of FIG. 8 bearing the same numbers as elements of FIG. 2 are as described in connection with FIG. 2 (however, rather than being located in or on the eating utensil, these components are located in or on accessory 800, which is in turn attached to an eating utensil). In some aspects, accessory 800 also includes sensor 812 carried by extension 814, which is a structural member connected to attachment 802 that extends to a location on the eating utensil where it is desired to place a sensor but not attachment 802. For example, extension 814 may extend from attachment 804, which is attached to a support portion of the eating utensil, to the ingestible substance-carrying portion of the eating utensil to position sensor 812 in or on the ingestible substance-carrying portion of the eating utensil, e.g. to sense a property of the ingestible substance. As indicated in FIG. 8, attachment 802 may include a variety of components, for example, a sleeve 804, a shell 806, a clamp 808, or an elastic portion, strap, clip or fastener 810 to secure accessory 800 to the eating utensil.

Figure 9B:
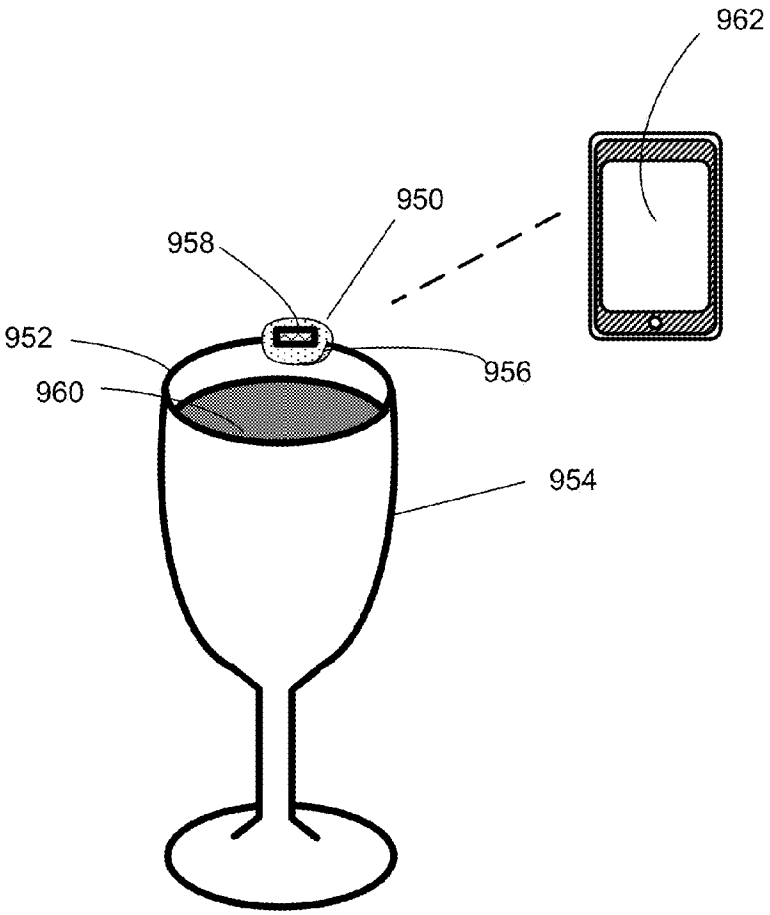
FIG. 9B depicts an accessory to an eating utensil communicating with a remote device.
Figure 9A:
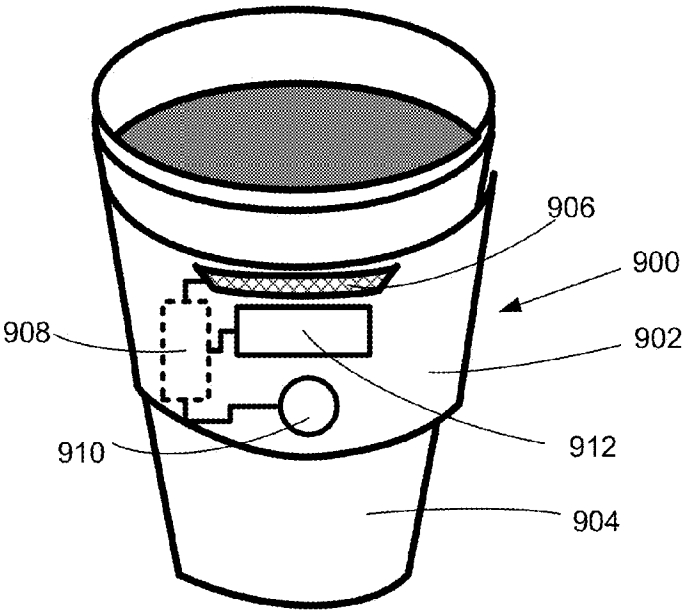
FIG. 9A depicts an accessory to an eating utensil.

FIG. 9A depicts an accessory 900 including sleeve 902 adapted to fit around a portion of eating utensil 904. In other embodiments, attachments may be configured to clamp onto portions of other types of eating utensils, e.g. to clamp onto the handle of a cup, the stem of a glass, the rim of a bowl, etc. In the example of FIG. 9A, sleeve 902 is adapted to fit around an exterior surface of eating utensil 904, which in this example is a cup. Sleeve 902 is substantially tubular. In related embodiments, a sleeve may be adapted to fit around a handle of the eating utensil such as a spoon or fork, around an exterior surface of a bowl, and so forth. Accessory 900 also includes at least one controllable odorant emitter 906, control circuitry 908, user input device 910, and display 912. In FIG. 9A, user input device 910 is a button, but could also be a switch or touchpad, for example. Display 912 is an LCD display. A user can input information regarding a beverage currently being consumed by depressing user input device 910 and scrolling through beverage options displayed on display 912. Data regarding the beverage selection can be stored in a memory device in control circuitry 908. An odorant can be emitted from controllable odorant emitter 906 to enhance the flavor of the beverage. Alternatively, if the consumer has already consumed more beverages of a particular type than is desirable (e.g. consuming too many calories, too much caffeine, or too much alcohol, as determined based on information pre-programmed into control circuitry 908 relating nutritional contents of particular beverages and desired consumption limits for the consumer), controllable odorant emitter 906 may release an odorant selected to discourage further consumption of the beverage, either by stimulating a sense of satiety or rendering the flavor of the beverage unpleasant.

FIG. 9B depicts an example of an accessory 950, which is configured to clamp onto a rim 952 of a glass 954. Accessory 950 is similar in configuration to 'wine glass charms' used to distinguish between wineglasses used by different people at a social gathering. Accessory 950 as shown in FIG. 9B includes an attachment formed of a resilient polymeric material that includes a slot 956 sized to slide onto and resiliently clamp to rim 952 of glass 954. Accessory 950 includes controllable odorant emitter 958 for releasing an odorant to either enhance the flavor of beverage 960 contained in glass 954, or alternatively, to discourage consumption of beverage 960. Odorant release is controlled by control circuitry in accessory 950, which is also in wireless communication with remote device 962, which in the present example is a cell phone. For example, data regarding beverage consumption, odorant release, and other system operational parameters can be transmitted from accessory 950 to remote device 962, where it can be stored and/or analyzed, and used by the consumer for personal health management purposes, or shared with a healthcare provider, for example. Instructions and device settings can be transmitted from remote device 962 to accessory 950. In an aspect, remote device 962 can function as a user interface to accessory 950.

Figure 10A:
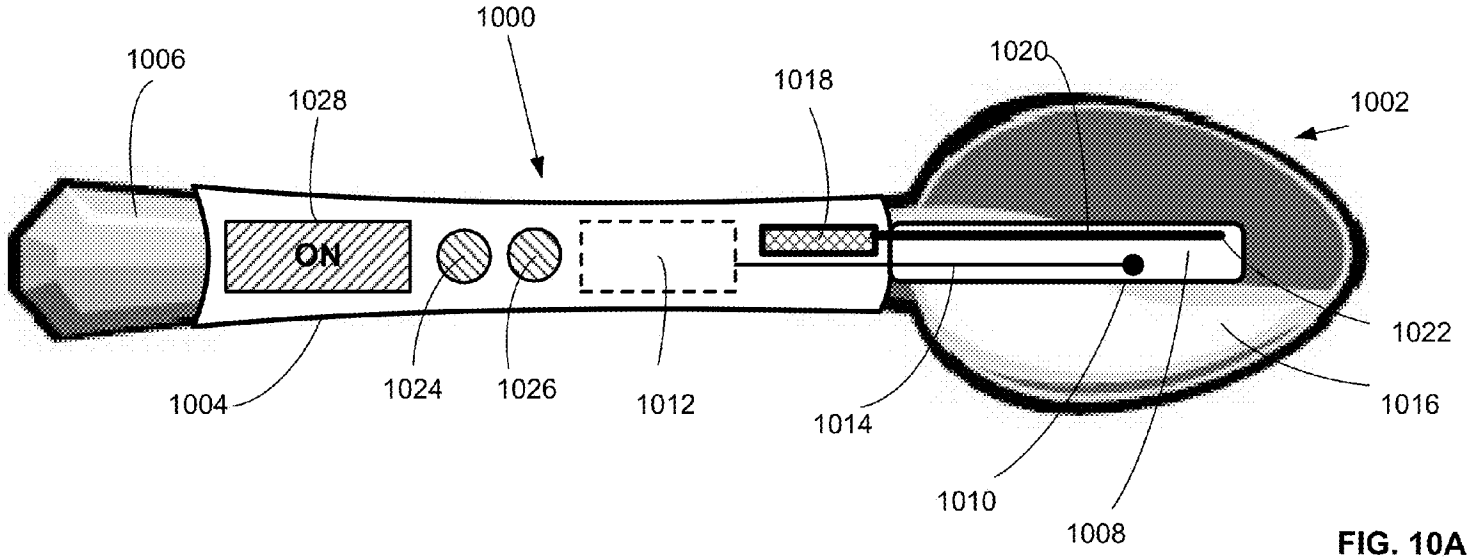
FIG. 10A is a top view of an accessory to an eating utensil attached to an eating utensil.
Figure 10B:
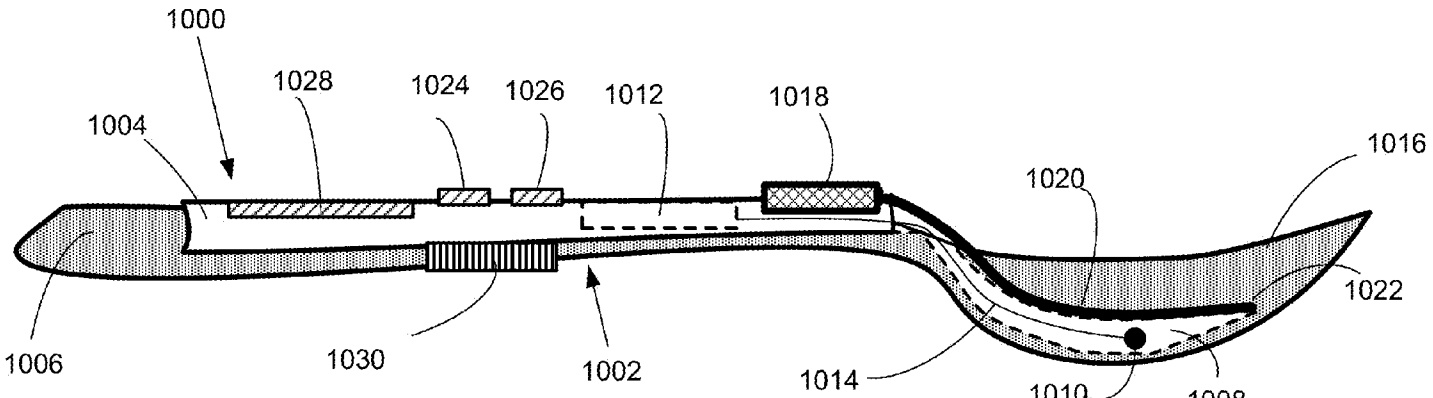
FIG. 10B is a side view of the accessory to an eating utensil and eating utensil of FIG. 10A.

FIGS. 10A and 10B depict an embodiment of an accessory 1000 to an eating utensil 1002 including an attachment 1004 in the form of a shell that is open at one side and adapted to fit against a portion of the eating utensil 1002 (here, attachment 1004 (shell) fits against support portion 1006 (handle) of eating utensil 1002. In the embodiment of FIGS. 10A and 10B, accessory 1000 includes an extension 1008 extending from attachment 1004 and carrying a sensor 1010, which is connected to control circuitry 1012 by wire 1014.

As can be seen in FIGS. 10A and 10B, attachment 1004 is configured to be secured to the support portion 1006 of eating utensil 1002, with extension 1008 extending from attachment 1004 to the ingestible substance-carrying portion 1016 of eating utensil 1002 when attachment 1004 is secured to support portion 1006 of eating utensil 1002, such that sensor 1010 is located at the ingestible substance-carrying portion 1016 of eating utensil 1002. Extension 1008 is shaped to conform to ingestible substance-carrying portion 1016 of eating utensil 1002 so that it does not interfere with normal use of eating utensil 1002.

As shown in FIGS. 10A and 10B, extension 1008 includes at least a portion (here, delivery tube 1020) of at least one controllable odorant emitter 1018. Extension 1008 extends from attachment 1004 to ingestible-substance carrying portion 1016 of the eating utensil, such that when the attachment 1004 is secured to support portion 1006 of eating utensil 1002, delivery tube 1020 is located at ingestible-substance carrying portion 1016 of eating utensil 1002. Delivery tube 1020 provides for delivery of at least one odorant at the ingestible-substance carrying portion 1016 of eating utensil 1002, via outlet 1022.

In an aspect, the attachment (shell 1004) includes at least one of an elastic portion 1030 (an elastic strap) for removably securing the attachment to the support portion 1006 of eating utensil 1002. Alternatively, or in addition, other types of fasteners, such as a strap or a clip could be used to secure accessory 1000 to eating utensil 1002.

In other respects, the components of the accessory are similar to those described above in connection with the eating utensil. For example, control circuitry 1012 is operatively connected to the at least one controllable odorant emitter 1018 and adapted to generate the control signal for controlling the at least one controllable odorant emitter 1018, and sensor 1010 is operatively connected to control circuitry 1012. In the example of FIGS. 10A and 10B, sensor 1010 is adapted to sense a parameter indicative of a weight of an ingestible substance carried by the ingestible substance-carrying portion. Control circuitry 1012 may be configured to generate a control signal for controlling controllable odorant emitter 1018 based at least in part on receipt of a sense signal from the sensor. Control circuitry 1012 may be programmable, and in various aspects includes a microprocessor, as discussed herein above. For example, control circuitry 1012 is programmed to release an appetite inhibiting odorant after a specified weight of food has been consumed, as detected by sensor 1010.

Accessory 1000 includes a first user-activatable switch 1024, which is operatively connected to controllable odorant emitter 1018, wherein the control signal is generated based at least in part on activation of the user-activatable switch. Accessory 1000 also includes a second user-activatable switch 1026. Accessory 1000 also includes output device 1028, here shown as a display for presenting information relating to the operation of the eating utensil (e.g., an LED, LCD, or 7 segment display). User-activatable switches 1024 and 1026 are used to program control circuitry 1012, e.g. to specify the type of food being consumed and the desired maximum number of calories to be consumed, which taken in combination with stored data in control circuitry 1012 regarding the caloric content of different types of food can be used to determine the maximum weight of food to be consumed by the consumer. Alternatively, one or more additional sensors on extension 1008 could be used to detect one or more components of the ingestible substance to determine the type of food and/or caloric content per mass of food.

As depicted in FIGS. 10A and 10B, controllable odorant emitter 1018 is located with respect to attachment 1004 such that when attachment 1004 is secured to eating utensil 1002, if substance-carrying portion of the eating utensil is positioned inside the mouth of the consumer, odorant emitted from the at least one controllable odorant emitter is delivered retronasally to the consumer (i.e., via outlet 1022 of delivery tube 1020).

Other configurations of an accessory are possible, for example, where the controllable odorant emitter is located with respect to the attachment such that when the attachment is secured to the eating utensil, if the ingestible substance-carrying portion of the eating utensil is positioned inside the mouth of the consumer, odorant emitted from the at least one controllable odorant emitter is delivered orthonasally to the consumer. In another aspect, the at least one controllable odorant emitter is located with respect to the attachment such that when the attachment is secured to the eating utensil, if the ingestible substance-carrying portion of the eating utensil is approaching the mouth of the consumer, odorant emitted from the at least one controllable odorant emitter is delivered orthonasally to the consumer. In another aspect, an accessory to an eating utensil can include a second controllable odorant emitter.

Figure 11:
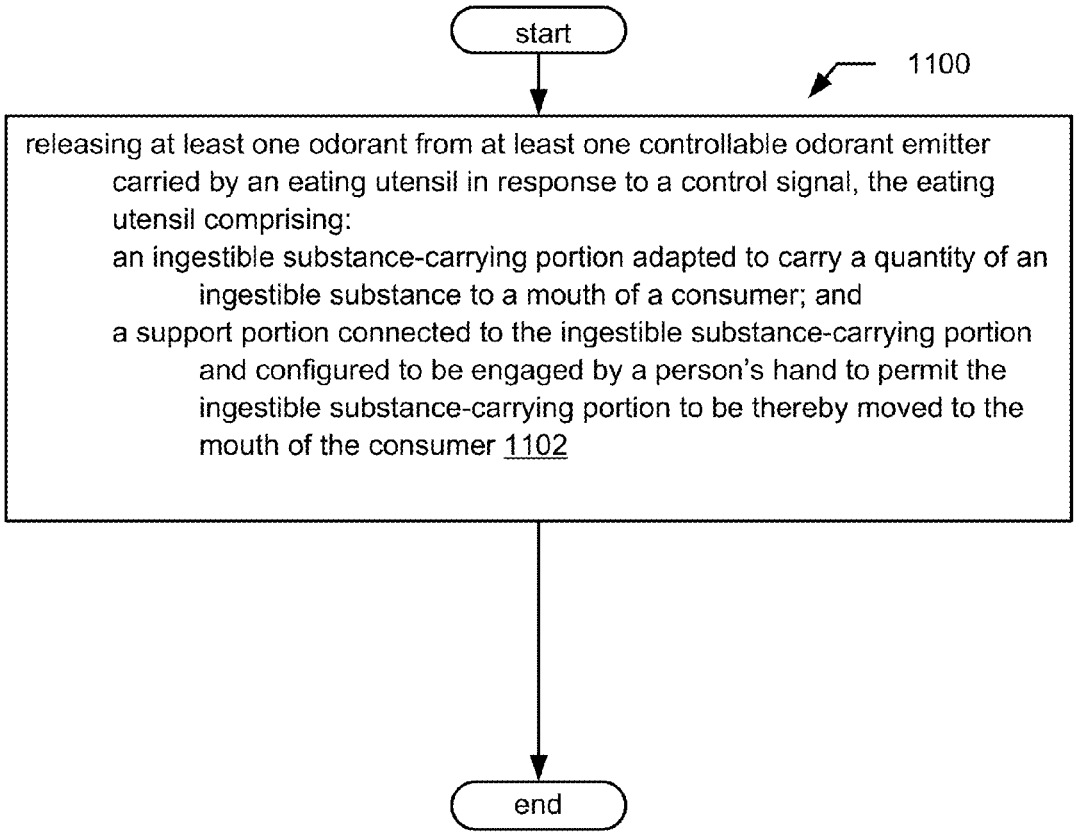
FIG. 11 is a flow diagram of a method of delivering an odorant in connection with use of an eating utensil for delivering food or drink to a subject.

FIG. 11 depicts a method 1100 of delivering an odorant in connection with use of an eating utensil of the type described herein for delivering food, drink or some other ingestible substance to a consumer. Method 1100 includes releasing at least one odorant from at least one controllable odorant emitter carried by an eating utensil in response to a control signal, the eating utensil comprising an ingestible substance-carrying portion adapted to carry a quantity of an ingestible substance to a mouth of a consumer, and a support portion connected to the ingestible substance-carrying portion and configured to be engaged by a person's hand to permit the ingestible substance-carrying portion to be thereby moved to the mouth of the consumer, as indicated at 1102.

FIGS. 12-22 depict variations and expansions of method 1100 as shown in FIG. 11. In the methods depicted in FIGS. 12-22, step 1102 is as described generally in connection with FIG. 11. Method steps outlined with dashed lines represent steps that are included in some, but not all method aspects, and combinations of steps other than those specifically depicted in the figures are possible as would be known by those having ordinary skill in the relevant art.

Figure 12:
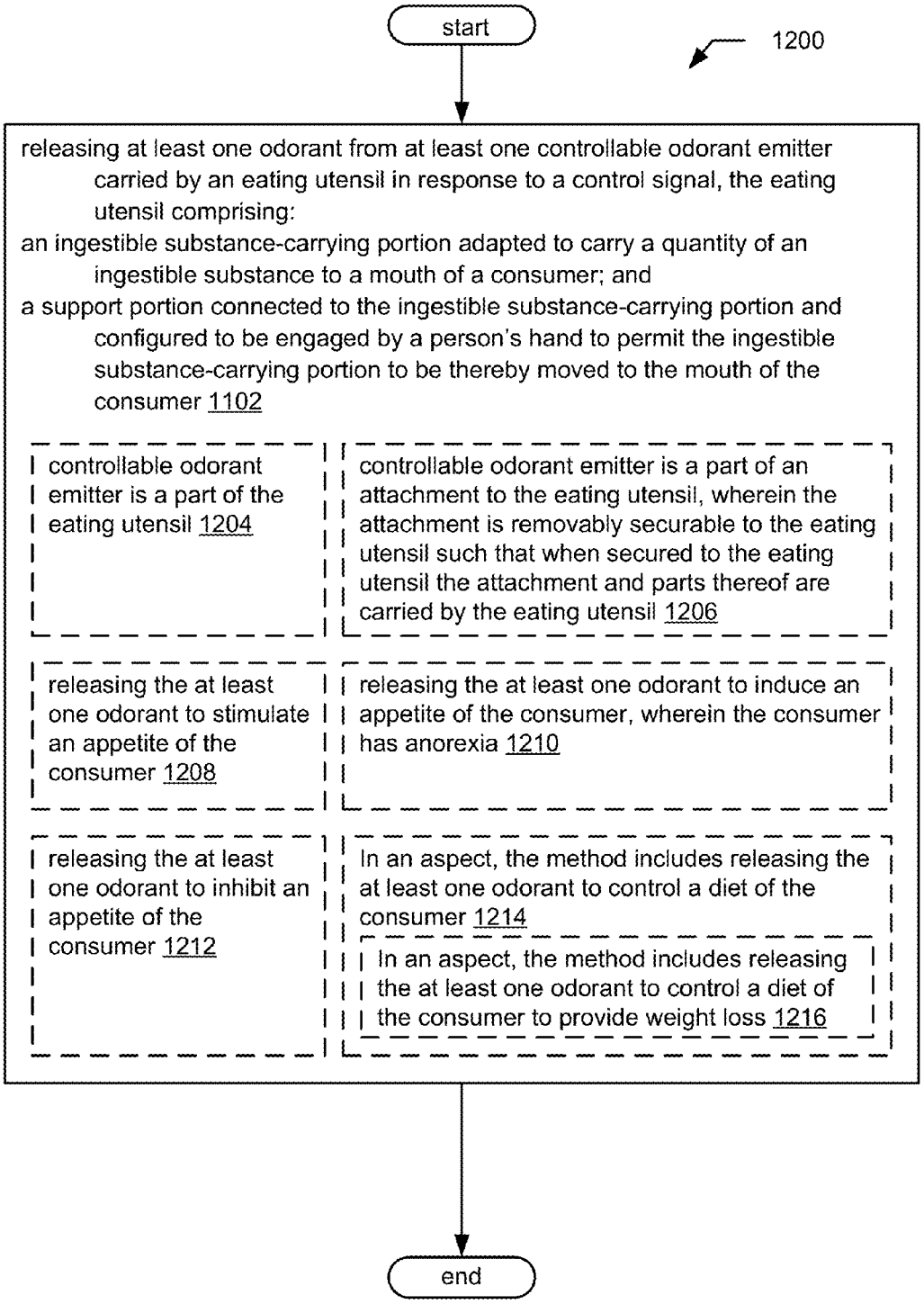
FIG. 12 is a flow diagram of a variant of the method of FIG. 11.

FIG. 12 depicts a method 1200 that includes releasing at least one odorant from at least one controllable odorant emitter carried by an eating utensil in response to a control signal (1102) as in FIG. 11. In an aspect of method 1200, the at least one controllable odorant emitter is a part of the eating utensil, as indicated at 1204. This method aspect is carried out with embodiments as depicted in FIGS. 1A, 1B, 2, 5A-5C, 6A-6C, and 7. In another aspect, as indicated at 1206, the at least one controllable odorant emitter is a part of an attachment to the eating utensil, wherein the attachment is removably securable to the eating utensil such that when secured to the eating utensil the attachment and parts thereof are carried by the eating utensil. This method aspect is carried out with embodiments as depicted in FIGS. 8, 9A, 9B, 10A and 10B.

Both type of odorant and release location can influence the effect of the odorant. In general, aromas delivered retronasally produce satiety. In addition, more complex aromas (e.g. mixtures of aroma compounds) are thought to be more effective for producing satiety, see e.g. Ruijschop et al., "Retronasal Aroma Release and Satiation: a Review", J. Agric. Food Chem., 2009, 57, 9888-9894 and Rovner, "Enhancing the aroma of food might help dieters eat less" Chemical and Engineering New, volume 88, number 11, pp. 51-52, Mar. 15, 2010; each of which is incorporated herein by reference. Butter aroma presented retronasally, especially during swallowing, increases perception of thickness and creaminess; aromas related to fat content (e.g., lactones), carbohydrate content (e.g., maltol), or breakdown of protein content (e.g., animalic) increase sensation of fullness (Ruijschop et al., "Retronasal Aroma Release and Satiation: a Review", J. Agric. Food Chem., 2009, 57, 9888-9894, which is incorporated herein by reference).

In various aspects, method 1200 includes releasing the at least one odorant to stimulate an appetite of the consumer, as indicated at 1208; releasing the at least one odorant to induce an appetite of the consumer, wherein the consumer has anorexia, as indicated at 1210; or releasing the at least one odorant to inhibit an appetite of the consumer, as indicated at 1212.

In another aspect, method 1200 includes releasing the at least one odorant to control a diet of the consumer, as indicated at 1214. For example, if the consumer is consuming a type or quantity of food or drink that is not an acceptable part of the consumer's diet (e.g., a food or drink that contains too many calories, sugar or fat, an allergen, alcohol) an odorant may be released to discourage consumption of the food or drink. In particular, method 1200 may include releasing the at least one odorant to control a diet of the consumer to provide weight loss, as indicated at 1216. Alternatively, an odorant may be released that encourages the consumer to consume particular types of food or drink that are considered to be safe or healthy for the consumer, for example.

Figure 13:
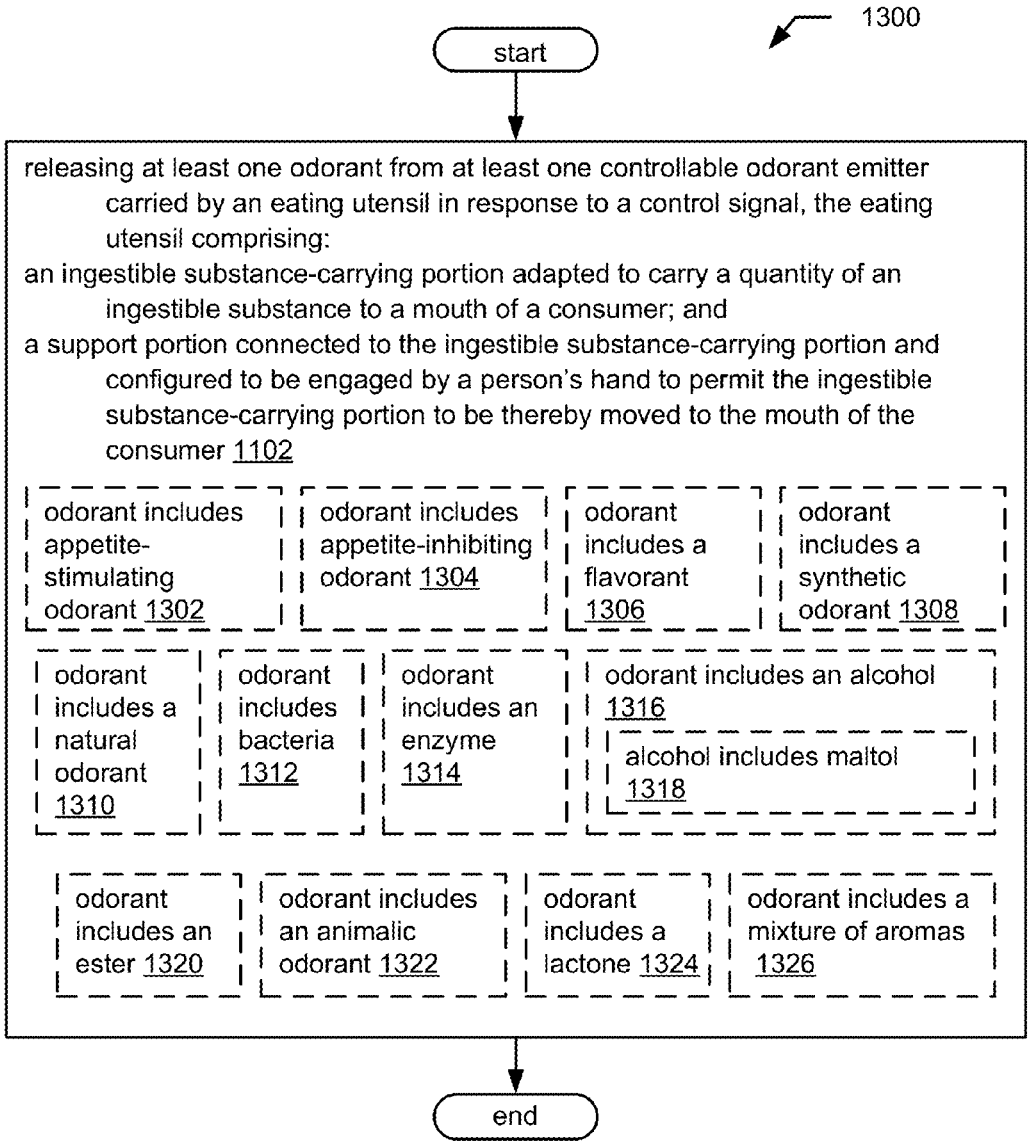
FIG. 13 is a flow diagram of a variant of the method of FIG. 11.

In various aspects of method 1300 depicted in FIG. 13, the odorant includes one or more of an appetite-stimulating odorant, as indicated at 1302; an appetite-inhibiting odorant, as indicated at 1304; a flavorant, as indicated at 1306; a synthetic odorant, as indicated at 1308; a natural odorant, as indicated at 1310; bacteria, as indicated at 1312; an enzyme, as indicated at 1314; an alcohol as indicated at 1316 (which may be, for example, maltol, as indicated at 1318); an ester, as indicated at 1320; an animalic odorant, as indicated at 1322; a lactone, as indicated at 1324; or a mixture of aromas, as indicated at 1326.

Figure 14:
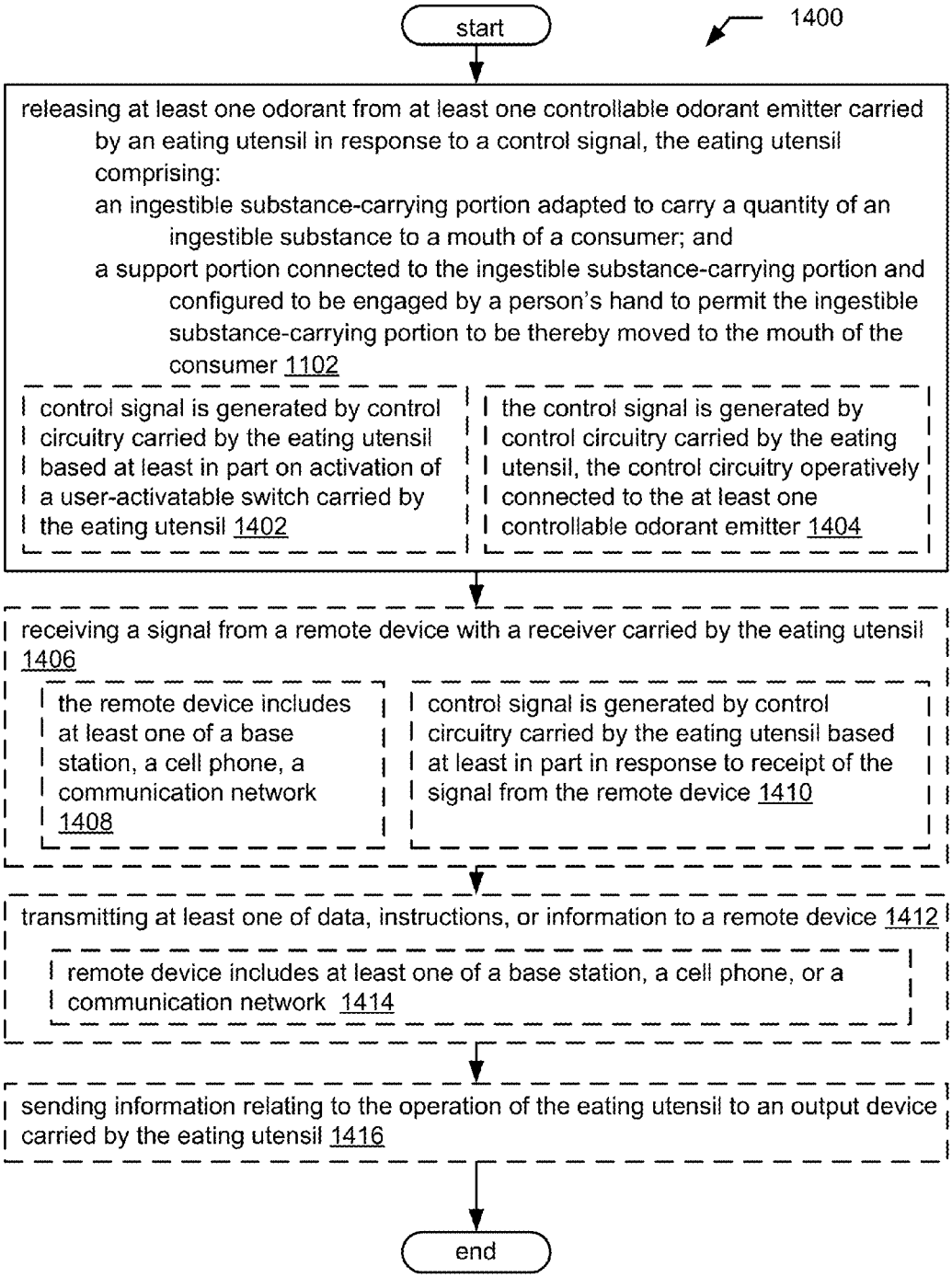
FIG. 14 is a flow diagram of a variant of the method of FIG. 11.

In an aspect of method 1400 depicted in FIG. 14, the control signal is generated by control circuitry carried by the eating utensil based at least in part on activation of a user-activatable switch carried by the eating utensil, as indicated at 1402. In various aspects, the control signal is generated by control circuitry carried by the eating utensil, where the control circuitry is operatively connected to the at least one controllable odorant emitter, as indicated at 1404.

In another aspect, method 1400 includes receiving a signal from a remote device with a receiver carried by the eating utensil, as indicated at 1406. For example, the remote device may include at least one of a base station, a cell phone, or a communication network, as indicated at 1408. The control signal may be generated by control circuitry carried by the eating utensil based at least in part in response to receipt of the signal from the remote device, as indicated at 1410.

Method 1400 may also include transmitting at least one of data, instructions, or information to a remote device, as indicated at 1412. Again, the remote device includes at least one of a base station, a cell phone, or a communication network, as indicated at 1414.

In another aspect, method 1400 includes sending information relating to the operation of the eating utensil to an output device carried by the eating utensil, as indicated at 1416.

Figure 15:
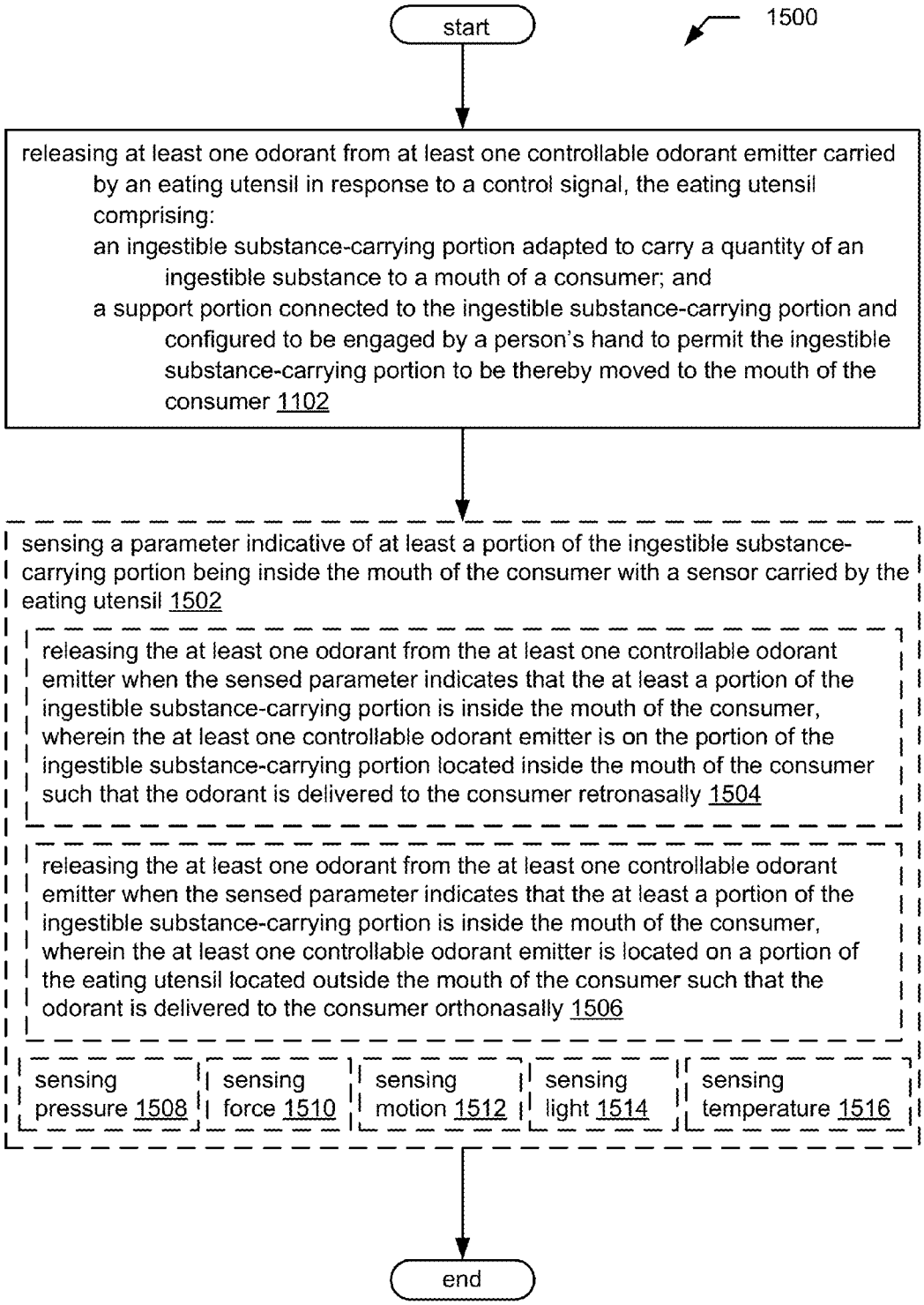
FIG. 15 is a flow diagram of a variant of the method of FIG. 11.

FIG. 15 depicts aspects of a method 1500 relating to sensing parameters with a sensor. In an aspect, method 1500 includes sensing a parameter indicative of at least a portion of the ingestible substance-carrying portion being inside the mouth of the consumer with a sensor carried by the eating utensil, as indicated at 1502. Method 1500 may further include releasing the at least one odorant from the at least one controllable odorant emitter when the sensed parameter indicates that the at least a portion of the ingestible substance-carrying portion is inside the mouth of the consumer, wherein the at least one controllable odorant emitter is on the portion of the ingestible substance-carrying portion located inside the mouth of the consumer such that the odorant is delivered to the consumer retronasally, as indicated at 1504. In another aspect, method 1500 includes releasing the at least one odorant from the at least one controllable odorant emitter when the sensed parameter indicates that the at least a portion of the ingestible substance-carrying portion is inside the mouth of the consumer, wherein the at least one controllable odorant emitter is located on a portion of the eating utensil located outside the mouth of the consumer such that the odorant is delivered to the consumer orthonasally, as indicated at 1506. In various aspects, sensing a parameter indicative of at least a portion of the ingestible substance-carrying portion being inside the mouth of the consumer includes sensing pressure, as indicated at 1508; sensing force, as indicated at 1510; sensing motion, as indicated at 1512; sensing light, as indicated at 1514; or sensing a temperature, as indicated at 1516.

Figure 16:
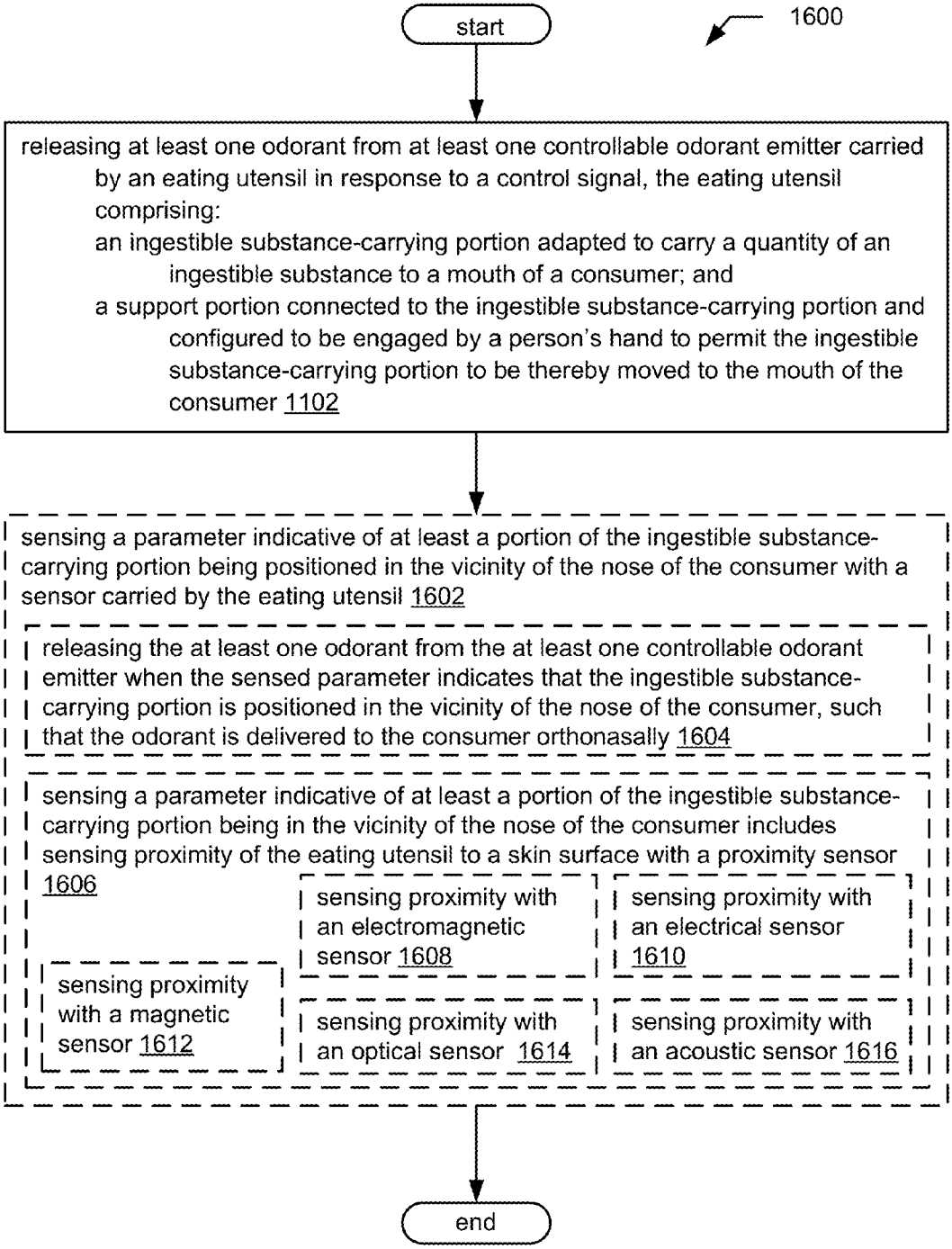
FIG. 16 is a flow diagram of a variant of the method of FIG. 11.

FIG. 16 depicts a method 1600, which includes sensing a parameter indicative of at least a portion of the ingestible substance-carrying portion being positioned in the vicinity of the nose of the consumer with a sensor carried by the eating utensil, as indicated at 1602. In an aspect, method 1600 further includes releasing the at least one odorant from the at least one controllable odorant emitter when the sensed parameter indicates that the ingestible substance-carrying portion is positioned in the vicinity of the nose of the consumer, such that the odorant is delivered to the consumer orthonasally, as indicated at 1604.

In an aspect, method 1600 includes sensing a parameter indicative of at least a portion of the ingestible substance-carrying portion being in the vicinity of the nose of the consumer includes sensing proximity of the eating utensil to a skin surface with a proximity sensor, as indicated at 1606. For example, sensing proximity of the eating utensil to a skin surface may include sensing proximity with an electromagnetic sensor, as indicated at 1608; sensing proximity with an electrical sensor, as indicated at 1610 (which may be, for example, and an inductive sensor or a capacitive sensor); a magnetic sensor, as indicated at 1612; an optical sensor (e.g., and IR sensor, a near-IR sensor, or a laser sensor), as indicated at 1614; or an acoustic sensor, as indicated at 1616.

Figure 17:
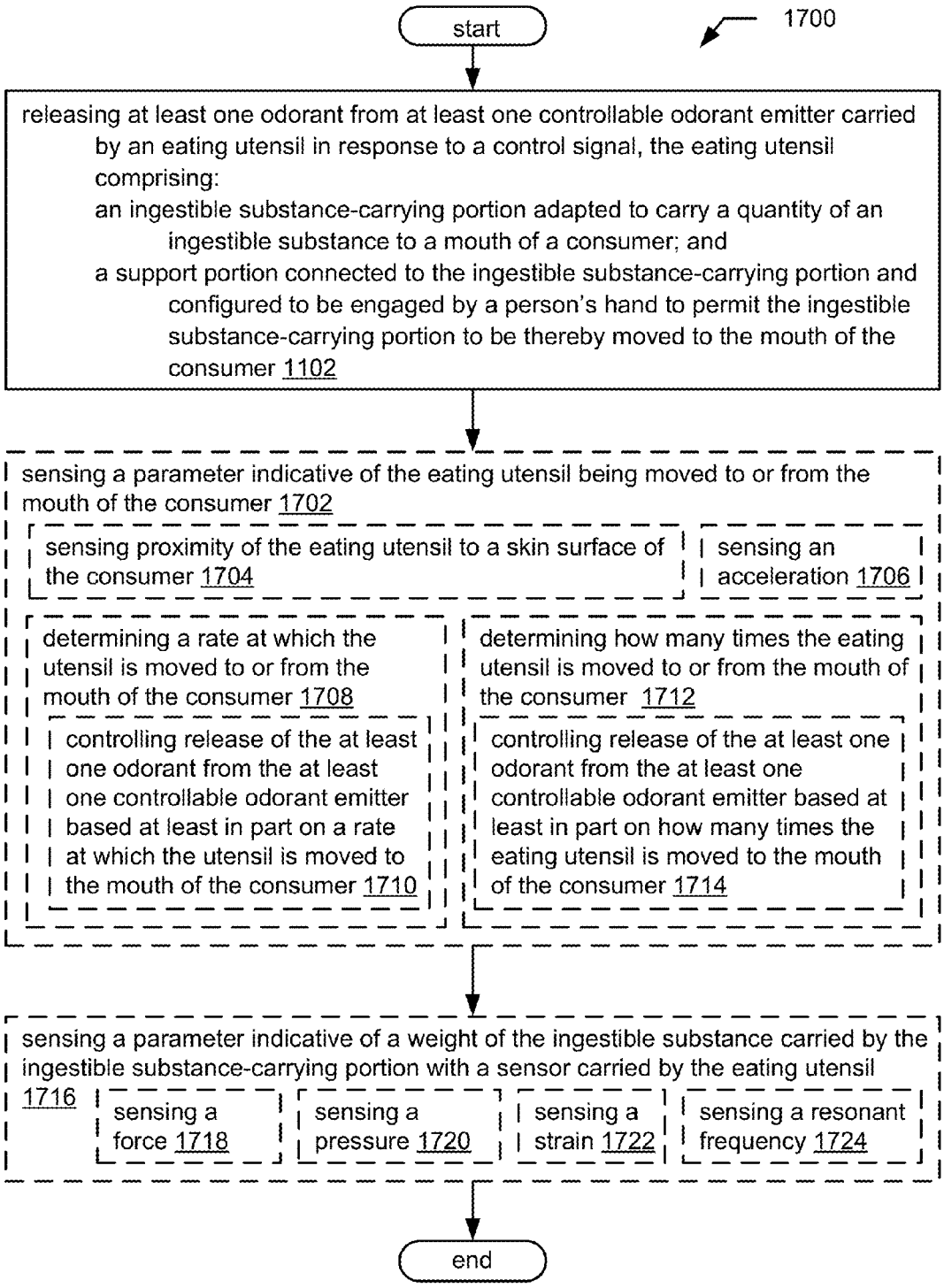
FIG. 17 is a flow diagram of a variant of the method of FIG. 11.

FIG. 17 depicts a method 1700, which includes sensing a parameter indicative of the eating utensil being moved to or from the mouth of the consumer, as indicated at 1702. In an aspect, sensing a parameter indicative of the eating utensil being moved to or from the mouth of the consumer includes sensing proximity of the eating utensil to a skin surface of the consumer, as indicated at 1704. In another aspect, sensing a parameter indicative of the eating utensil being moved to or from the mouth of the consumer includes sensing an acceleration, as indicated at 1706. In still another aspect, method 1700 includes determining a rate at which the utensil is moved to or from the mouth of the consumer, as indicated at 1708. Method 1700 may then also include controlling release of the at least one odorant from the at least one controllable odorant emitter based at least in part on a rate at which the utensil is moved to the mouth of the consumer, as indicated at 1710.

In another aspect, method 1700 includes determining how many times the eating utensil is moved to or from the mouth of the consumer, as indicated at 1712. Method 1700 may then also include controlling release of the at least one odorant from the at least one controllable odorant emitter based at least in part on how many times the eating utensil is moved to the mouth of the consumer, as indicated at 1714.

In another aspect, method 1700 includes sensing a parameter indicative of a weight of the ingestible substance carried by the ingestible substance-carrying portion with a sensor carried by the eating utensil, as indicated at 1716. Sensing a parameter indicative of the weight of the ingestible substance carried by the ingestible substance-carrying portion may include, for example, sensing a force, as indicated at 1718; a pressure, as indicated at 1720; a strain, as indicated at 1722; or a resonant frequency, as indicated at 1724.

Figure 18:
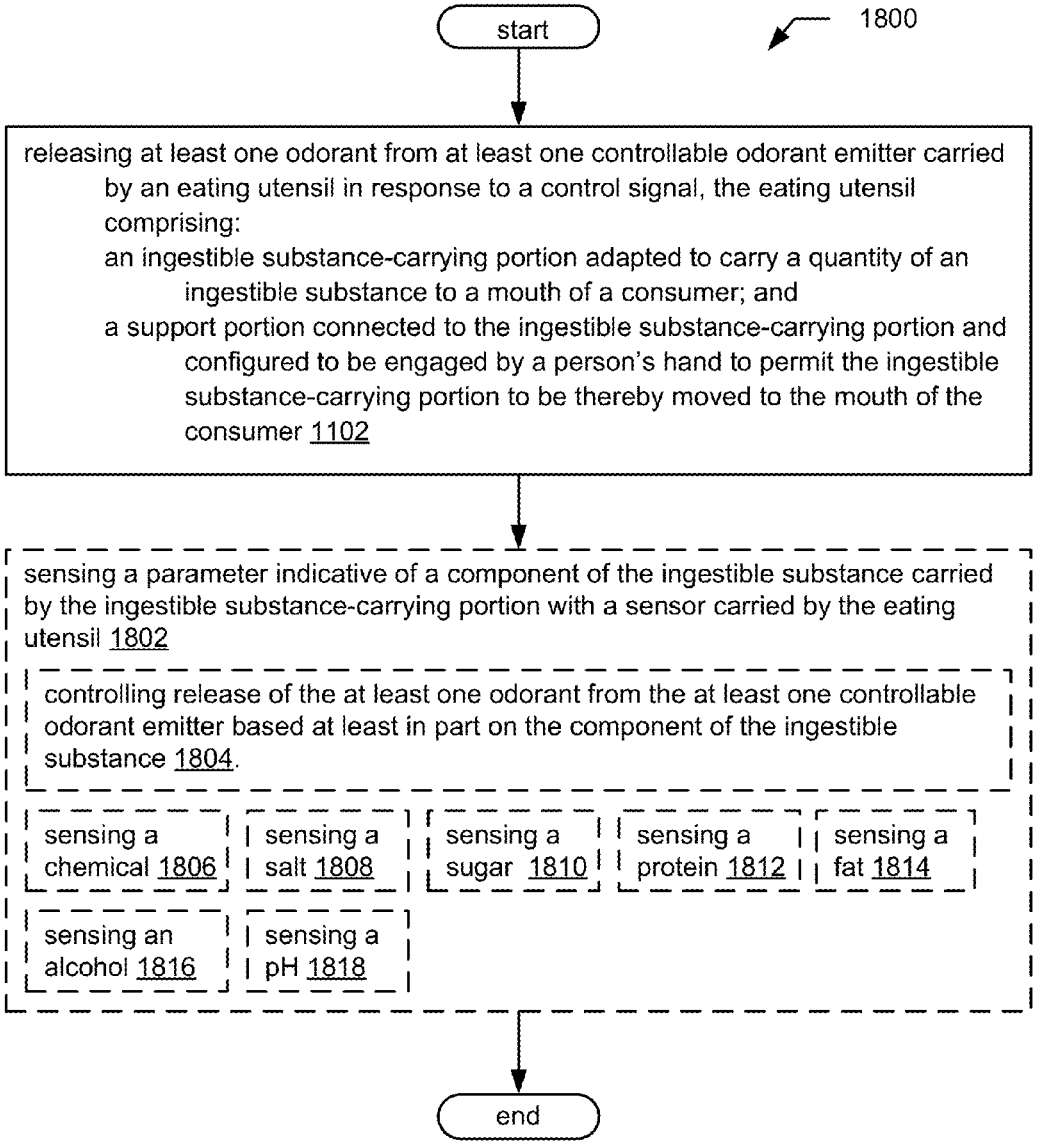
FIG. 18 is a flow diagram of a variant of the method of FIG. 11.

FIG. 18 depicts a method 1800, which includes sensing a parameter indicative of a component of the ingestible substance carried by the ingestible substance-carrying portion with a sensor carried by the eating utensil, as indicated at 1802. In an aspect, method 1800 includes controlling release of the at least one odorant from the at least one controllable odorant emitter based at least in part on the component of the ingestible substance, as indicated at 1804. In various aspects of method 1800, sensing the parameter indicative of the component of the ingestible substance includes sensing a chemical, as indicated at 1806; a salt, as indicated at 1808; a sugar, as indicated at 1810; a protein, as indicated at 1812; a fat, as indicated at 1814; an alcohol, as indicated at 1816; or a pH, as indicated at 1818.

Figure 19:
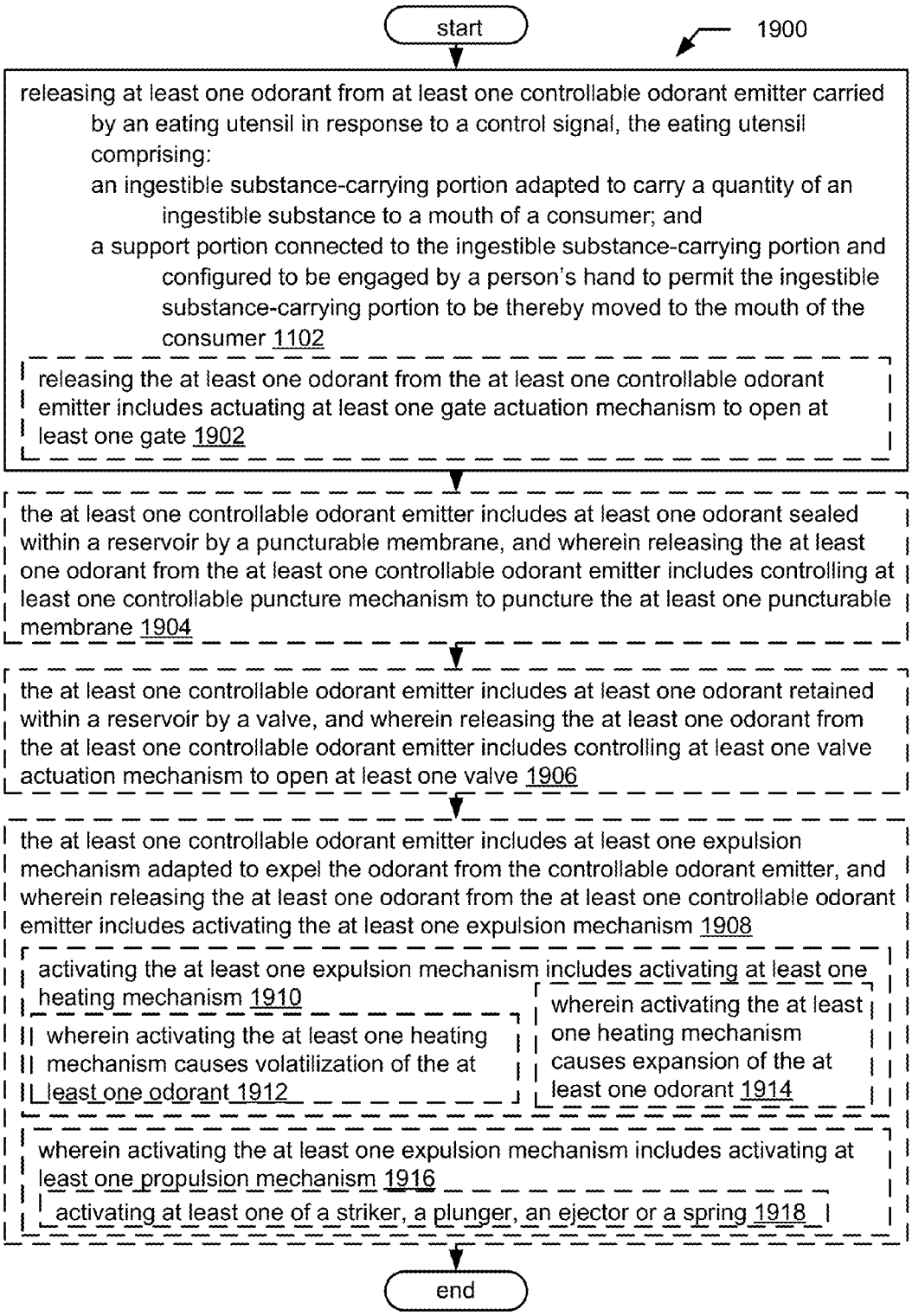
FIG. 19 is a flow diagram of a variant of the method of FIG. 11.

FIG. 19 depicts a method 1900. In an aspect of method 1900, releasing the at least one odorant from the at least one controllable odorant emitter may include actuating at least one gate actuation mechanism to open at least one gate, as indicated at 1902. In an aspect, the at least one controllable odorant emitter includes at least one odorant sealed within a reservoir by a puncturable membrane, and wherein releasing the at least one odorant from the at least one controllable odorant emitter includes controlling at least one controllable puncture mechanism to puncture the at least one puncturable membrane, as indicated at 1904. In another aspect, the at least one controllable odorant emitter includes at least one odorant retained within a reservoir by a valve, and wherein releasing the at least one odorant from the at least one controllable odorant emitter includes controlling at least one valve actuation mechanism to open at least one valve, as indicated at 1906.

In an aspect, the at least one controllable odorant emitter includes at least one expulsion mechanism adapted to expel the odorant from the controllable odorant emitter, and wherein releasing the at least one odorant from the at least one controllable odorant emitter includes activating the at least one expulsion mechanism, as indicated at 1908. For example, activating the at least one expulsion mechanism may include activating at least one heating mechanism, as indicated at 1910, e.g. to cause one or more of volatilization or expansion of the at least one odorant, as indicated at 1912 and 1914, respectively.

In another aspect, activating the at least one expulsion mechanism includes activating at least one propulsion mechanism, as indicated at 1916, which may be, for example, at least one of a striker, a plunger, an ejector or a spring, as indicated at 1918.

Figure 20:
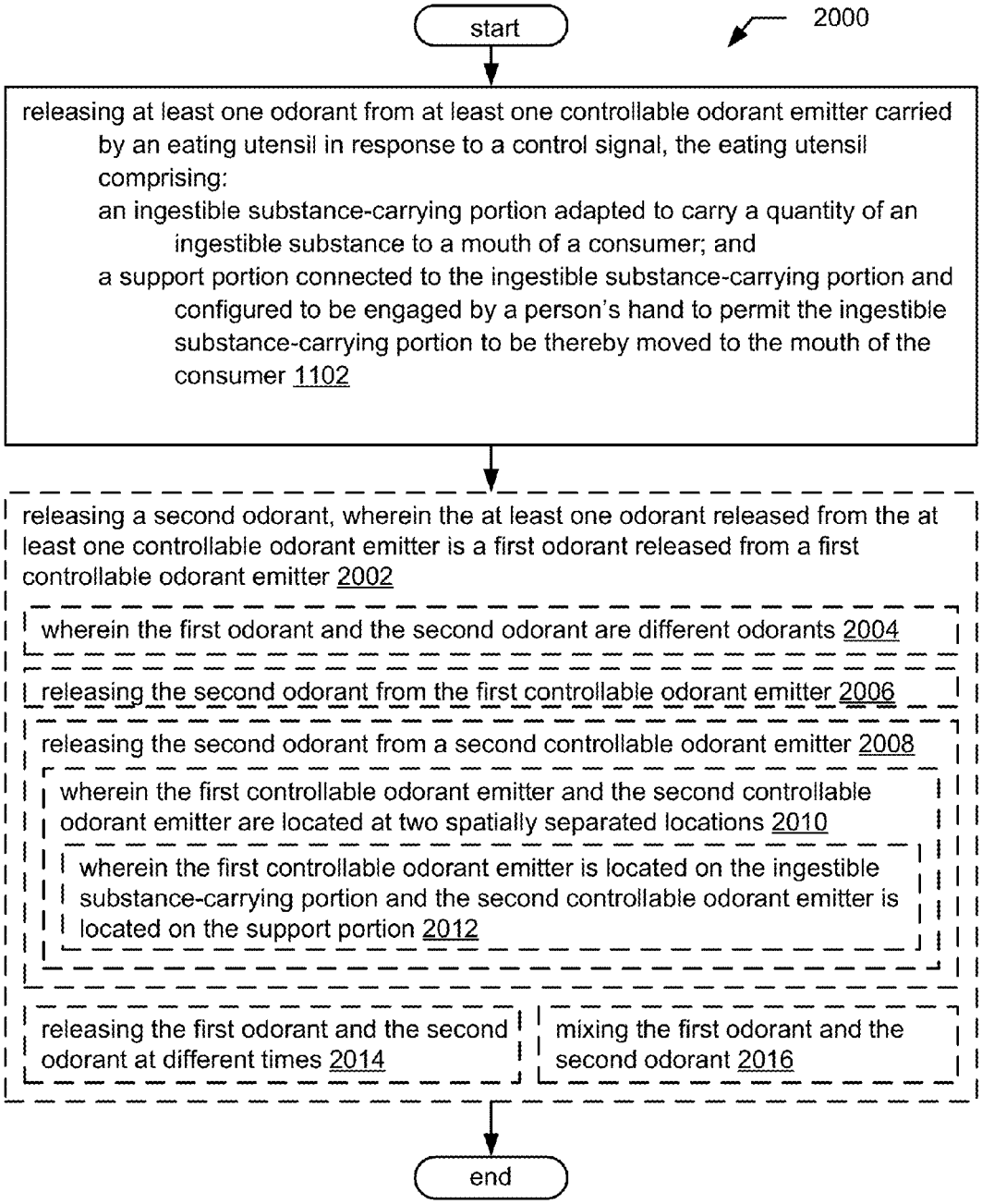
FIG. 20 is a flow diagram of a variant of the method of FIG. 11.

FIG. 20 depicts a method 2000, which includes releasing a second odorant, wherein the at least one odorant released from the at least one controllable odorant emitter is a first odorant released from a first controllable odorant emitter, as indicated at 2002. In an aspect, the first odorant and the second odorant are different odorants, as indicated at 2004.

In an aspect, method 2000 includes releasing the second odorant from the first controllable odorant emitter, as indicated at 2006. Alternatively, method 2000 includes releasing the second odorant from a second controllable odorant emitter, as indicated at 2008. In an aspect, the first controllable odorant emitter and the second controllable odorant emitter are located at two spatially separated locations, as indicated at 2010. For example, the first controllable odorant emitter may be located on the ingestible substance-carrying portion and the second controllable odorant emitter located on the support portion, as indicated at 2012.

In an aspect, method 2000 includes releasing the first odorant and the second odorant at different times, as indicated at 2014. In another aspect, method 2000 includes mixing the first odorant and the second odorant, as indicated at 2016, e.g. by using a mixing chamber as depicted in FIG. 2, 3B or 8.

Figure 21:
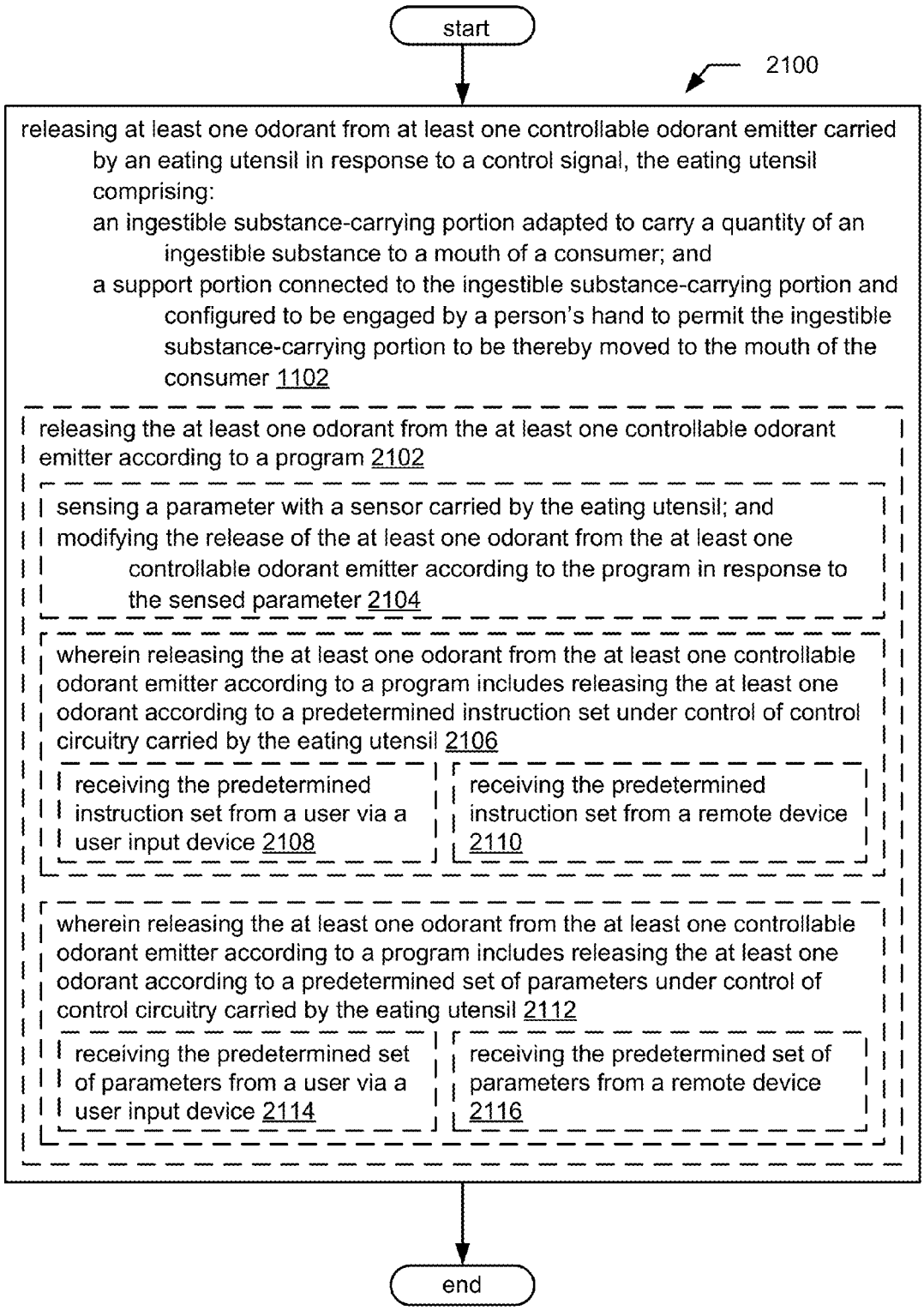
FIG. 21 is a flow diagram of a variant of the method of FIG. 11.

FIG. 21 depicts a method 2100, which in an aspect includes releasing the at least one odorant from the at least one controllable odorant emitter according to a program, as indicated at 2102. In an aspect, method 2100 includes sensing a parameter with a sensor carried by the eating utensil, and modifying the release of the at least one odorant from the at least one controllable odorant emitter according to the program in response to the sensed parameter, as indicated at 2104.

In an aspect of method 2100, releasing the at least one odorant from the at least one controllable odorant emitter according to a program may include releasing the at least one odorant according to a predetermined instruction set under control of control circuitry carried by the eating utensil, as indicated at 2106. The method may further include receiving the predetermined instruction set from a user via a user input device, as indicated at 2108, or (alternatively, or in addition) receiving the predetermined instruction set from a remote device, as indicated at 2110.

In a further aspect, releasing the at least one odorant from the at least one controllable odorant emitter according to a program includes releasing the at least one odorant according to a predetermined set of parameters under control of control circuitry carried by the eating utensil, as indicated at 2112. In various aspects, method 2100 includes receiving the predetermined set of parameters from a user via a user input device, as indicated at 2114, or receiving the predetermined set of parameters from a remote device, as indicated at 2116.

Figure 22:
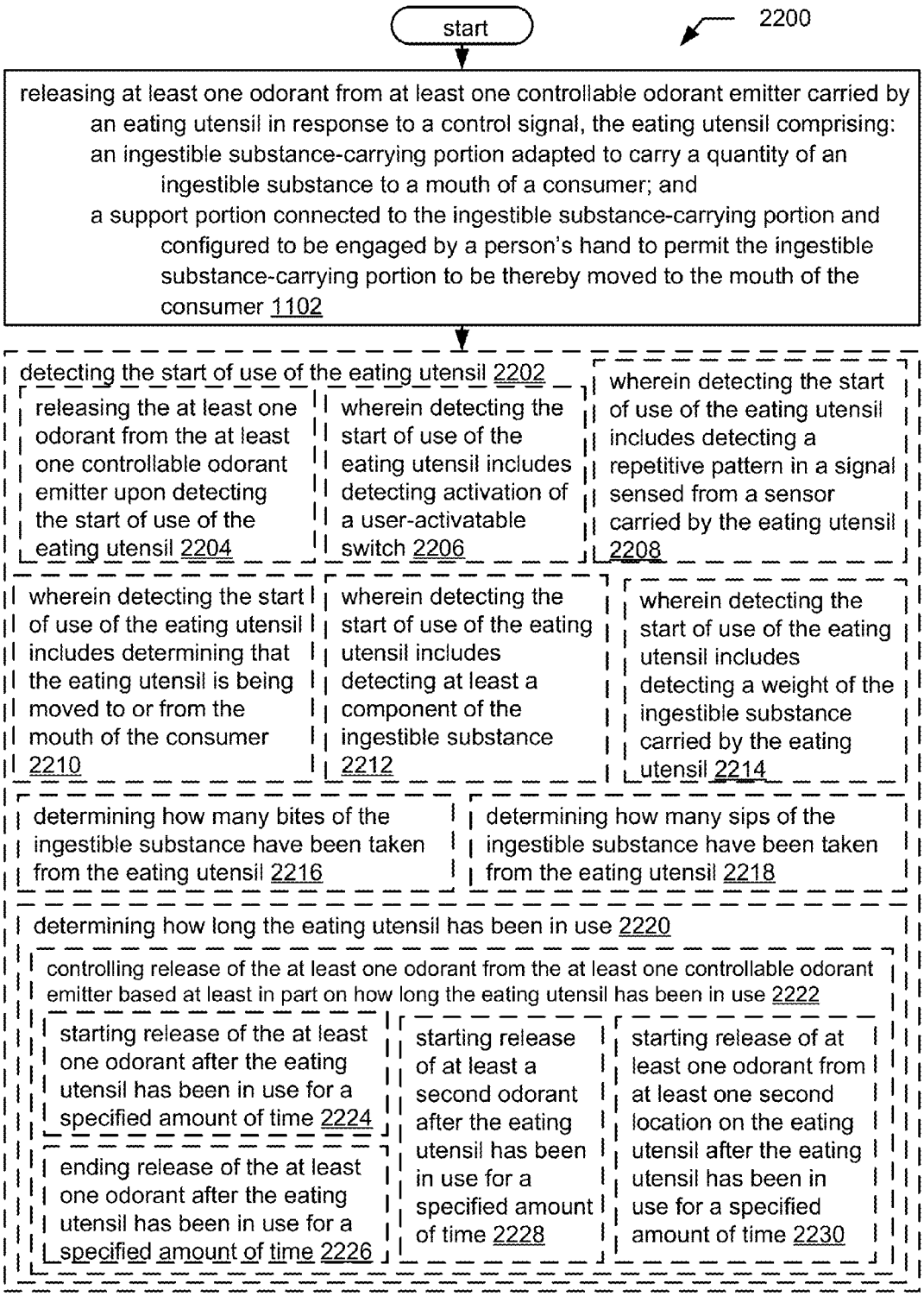
FIG. 22 is a flow diagram of a variant of the method of FIG. 11.

As depicted in FIG. 22, a method 2200 includes detecting the start of use of the eating utensil, as indicated at 2202. Method 2200 may then include releasing the at least one odorant from the at least one controllable odorant emitter upon detecting the start of use of the eating utensil, as indicated at 2204.

Detecting the start of use of the eating utensil may be performed in a number of ways, including detecting activation of a user-activatable switch, as indicated at 2206, or detecting a repetitive pattern in a signal sensed from a sensor carried by the eating utensil, as indicated at 2208. For example, a repetitive pattern may be repetitive movement of an eating utensil toward and away from a consumer's mouth, as indicated by changes in an acceleration signal detected with an accelerometer. As another example, a light sensor on an ingestible substance-carrying portion of an eating utensil may indicate a light level corresponding to ambient light when the eating utensil is outside the consumer's mouth, and a low light level or lack of light when the ingestible substance-carrying portion of the eating utensil is placed within the consumer's mouth. Various other parameters may be sensed that vary in a repetitive or cyclical manner while the consumer eats. Detection and analysis of the repetitive pattern can be used to determine how long the consumer has been eating or drinking, and how much the consumer has consumed. Detection and analysis of the repetitive pattern can be used to anticipate or predict when the eating utensil will approach or be placed in the consumer's mouth, and therefor may be used as a basis for controlling the timing of release of odorant.

In further aspects, detecting the start of use of the eating utensil includes determining that the eating utensil is being moved to or from the mouth of the consumer, as indicated at 2210; detecting at least a component of the ingestible substance, as indicated at 2212; or detecting a weight of the ingestible substance carried by the eating utensil, as indicated at 2214.

Method 2200 may further include determining how many bites of the ingestible substance have been taken from the eating utensil, as indicated at 2216, or determining how many sips of the ingestible substance have been taken from the eating utensil, as indicated at 2218.

In an aspect, method 2200 includes determining how long the eating utensil has been in use, as indicated at 2220. Method 2200 may then also include controlling release of the at least one odorant from the at least one controllable odorant emitter based at least in part on how long the eating utensil has been in use, as indicated 2222. For example, in various aspects, controlling release of the at least one odorant from the at least one controllable odorant emitter based at least in part on how long the eating utensil has been in use includes starting release of the at least one odorant after the eating utensil has been in use for a specified amount of time, as indicated at 2224; ending release of the at least one odorant after the eating utensil has been in use for a specified amount of time, as indicated at 2226; starting release of at least a second odorant after the eating utensil has been in use for a specified amount of time, as indicated at 2228 or starting release of at least one odorant from at least one second location on the eating utensil after the eating utensil has been in use for a specified amount of time, as indicated at 2230.

Times for starting or ending release of odorants; maximum calories, weights, or volumes of foods, beverages, or other ingestible substances; or other parameters may be programmed into the control circuitry by the consumer or other user of the eating utensil, or the device may come pre-programmed. Odorant release may be controlled based on weight, mass, volume, or the like of the ingestible material (or specific component thereof) consumed. One or more schedule for controlling release of one or more odorants (e.g. in a pattern) may be stored in a data storage device in the control circuitry (e.g. control circuitry 208 in FIG. 2). Such a schedule may be manually entered or recorded by a consumer and/or downloaded to the data storage device. Methods for entering, recording, or downloading release schedules may be generally as described in commonly owned U.S. patent application Ser. No. 13/675,935, entitled "Actively Released Food Additives," to Baym et al., filed 13 Nov. 2012, which is incorporated herein by reference.

In a general sense, it will be recognized that the various embodiments described herein can be implemented, individually and/or collectively, by various types of electrical circuitry having a wide range of electrical components such as hardware, software, firmware, and/or virtually any combination thereof. Electrical circuitry (including control circuitry 208 and electrical circuitry in remote device 232 depicted in FIG. 2, for example) includes electrical circuitry having at least one discrete electrical circuit, electrical circuitry having at least one integrated circuit, electrical circuitry having at least one application-specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (which may include, for example, random access, flash, read only, volatile or non-volatile memory devices, etc.), electrical circuitry forming a communications device (e.g., a modem, communications switch, optical-electrical equipment, etc.), and/or any non-electrical analog thereto, such as optical or other analogs (e.g., graphene based circuitry). In a general sense, it will be recognized that the various aspects described herein which can be implemented, individually and/or collectively, by a wide range of hardware, software, firmware, and/or any combination thereof can be viewed as being composed of various types of "electrical circuitry."

In various embodiments, methods as described herein may be performed according to instructions implementable in hardware, software, and/or firmware. Such instructions may be stored in non-transitory machine-readable data storage media, for example. It will be recognized that the state of the art has progressed to the point where there is little distinction left between hardware, software, and/or firmware implementations of aspects of systems; the use of hardware, software, and/or firmware is generally (but not always, in that in certain contexts the choice between hardware and software can become significant) a design choice representing cost vs. efficiency tradeoffs. There are various vehicles by which processes and/or systems and/or other technologies described herein can be effected (e.g., hardware, software, and/or firmware), and the preferred vehicle will vary with the context in which the processes and/or systems and/or other technologies are deployed. For example, if an implementer determines that speed and accuracy are paramount, the implementer may opt for a mainly hardware and/or firmware vehicle; alternatively, if flexibility is paramount, the implementer may opt for a mainly software implementation; or, yet again alternatively, the implementer may opt for some combination of hardware, software, and/or firmware in one or more machines, compositions of matter, and articles of manufacture. Hence, there are several possible vehicles by which the processes and/or devices and/or other technologies described herein may be effected, none of which is inherently superior to the other in that any vehicle to be utilized is a choice dependent upon the context in which the vehicle will be deployed and the specific concerns (e.g., speed, flexibility, or predictability) of the implementer, any of which may vary. It will be recognized that optical aspects of implementations will typically employ optically-oriented hardware, software, and or firmware.

In some implementations described herein, logic and similar implementations may include software or other control structures. Electrical circuitry, for example, may have one or more paths of electrical current constructed and arranged to implement various functions as described herein. In some implementations, one or more media may be configured to bear a device-detectable implementation when such media hold or transmit device detectable instructions operable to perform as described herein. In some variants, for example, implementations may include an update or modification of existing software or firmware, or of gate arrays or programmable hardware, such as by performing a reception of or a transmission of one or more instructions in relation to one or more operations described herein. Alternatively or additionally, in some variants, an implementation may include special-purpose hardware, software, firmware components, and/or general-purpose components executing or otherwise invoking special-purpose components.

Implementations may include executing a special-purpose instruction sequence or invoking circuitry for enabling, triggering, coordinating, requesting, or otherwise causing one or more occurrences of virtually any functional operations described herein. In some variants, operational or other logical descriptions herein may be expressed as source code and compiled or otherwise invoked as an executable instruction sequence. In some contexts, for example, implementations may be provided, in whole or in part, by source code, such as C++, or other code sequences. In other implementations, source or other code implementation, using commercially available and/or techniques in the art, may be compiled/implemented/translated/converted into a high-level descriptor language (e.g., initially implementing described technologies in C or C++ programming language and thereafter converting the programming language implementation into a logic-synthesizable language implementation, a hardware description language implementation, a hardware design simulation implementation, and/or other such similar mode(s) of expression). For example, some or all of a logical expression (e.g., computer programming language implementation) may be manifested as a Verilog-type hardware description (e.g., via Hardware Description Language (HDL) and/or Very High Speed Integrated Circuit Hardware Descriptor Language (VHDL)) or other circuitry model which may then be used to create a physical implementation having hardware (e.g., an Application Specific Integrated Circuit). Those skilled in the art will recognize how to obtain, configure, and optimize suitable transmission or computational elements, material supplies, actuators, or other structures in light of these teachings.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In an embodiment, several portions of the subject matter described herein may be implemented via Application Specific Integrated Circuits (ASICs), Field Programmable Gate Arrays (FPGAs), digital signal processors (DSPs), or other integrated formats. However, it will be recognized that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing media include, but are not limited to non-transitory machine-readable data storage media such as a recordable type medium such as a floppy disk, a hard disk drive, a Compact Disc (CD), a Digital Video Disk (DVD), a digital tape, a computer memory, etc. A signal bearing medium may also include transmission type medium such as a digital and/or an analog communication medium (e.g., a fiber optic cable, a waveguide, a wired communications link, a wireless communication link (e.g., transmitter, receiver, transmission logic, reception logic, etc.) and so forth).

FIG. 23 depicts an article of manufacture 2300 that includes one or more non-transitory machine-readable data storage media 2302 bearing one or more instructions 2304 for controlling the release of at least one odorant from at least one controllable odorant emitter carried by an eating utensil with a control signal, the eating utensil comprising an ingestible substance-carrying portion adapted to carry a quantity of an ingestible substance to a mouth of a consumer; and a support portion connected to the ingestible substance-carrying portion and configured to be engaged by a person's hand to permit the ingestible substance-carrying portion to be thereby moved to the mouth of the consumer.

Instructions 2304 depicted in FIG. 23 substantially correspond to method 1100 shown in FIG. 11. Other variants of methods as depicted and described herein can be implemented through the use of non-transitory machine-readable data storage media bearing one or more suitable instructions.

For example, in an aspect, the one or more non-transitory machine-readable data storage media 2302 may bear one or more instructions for performing aspects of a method 1400 as shown in FIG. 14, including generating the control signal with control circuitry carried by the eating utensil based at least in part on activation of a user-activatable switch carried by the eating utensil, as shown at 1402. For example, the one or more non-transitory machine-readable data storage media may bear one or more instructions for receiving a signal from a remote device with a receiver carried by the eating utensil, as shown at 1406. For example, the one or more instructions for receiving a signal from a remote device may include one or more instructions for receiving a signal from at least one of a base station, a cell phone, or a communication network. In an aspect, the one or more non-transitory machine-readable data storage media bear one or more instructions for generating the control signal with control circuitry carried by the eating utensil based at least in part in response to receipt of the signal from the remote device. In another aspect, the one or more non-transitory machine-readable data storage media bear one or more instructions for transmitting at least one of data, instructions, or information to a remote device from the eating utensil.

In an aspect, the one or more instructions for transmitting at least one of data, instructions, or information to a remote device include one or more instructions for transmitting at least one of data, instructions, or information to at least one of a base station, a cell phone, or a communication network. In another aspect, the one or more non-transitory machine-readable data storage media bear one or more instructions for sending information relating to the operation of the eating utensil to an output device carried by the eating utensil.

The one or more non-transitory machine-readable data storage media 2302 may bear one or more instructions for performing aspects of a method 1400 as shown at 1404 in FIG. 14. For example, the one or more non-transitory machine-readable data storage media may bear one or more instructions for generating the control signal with control circuitry carried by the eating utensil and operatively connected to the at least one controllable odorant emitter.

The one or more non-transitory machine-readable data storage media 2302 may bear one or more instructions for performing aspects of a method 1500 as shown in FIG. 15. For example, the one or more non-transitory machine-readable data storage media bear one or more instructions for sensing a parameter indicative of at least a portion of the ingestible substance-carrying portion being inside the mouth of the consumer with a sensor carried by the eating utensil, as shown at 1502 in FIG. 15.

In an aspect, the one or more non-transitory machine-readable data storage media 2302 in FIG. 23 bear one or more instructions for performing aspects of a method 1600 as shown in FIG. 16. For example, the one or more non-transitory machine-readable data storage media may bear one or more instructions for sensing a parameter indicative of at least a portion of the ingestible substance-carrying portion being positioned in the vicinity of the nose of the consumer with a sensor carried by the eating utensil, as indicated at 1602. In an aspect, the one or more non-transitory machine-readable data storage media bear one or more instructions for releasing the at least one odorant from the at least one controllable odorant emitter when the ingestible substance-carrying portion is positioned in the vicinity of the nose of the consumer such that the odorant is delivered to the consumer orthonasally. In an aspect, the one or more instructions for sensing a parameter indicative of at least a portion of the ingestible substance-carrying portion being in the vicinity of the nose of the consumer include one or more instructions for sensing proximity of the eating utensil to a skin surface with a proximity sensor, for example, sensing proximity with an electromagnetic sensor, an electrical sensor, a magnetic sensor, an optical sensor, or an acoustic sensor.

In an aspect, the one or more non-transitory machine-readable data storage media 2302 bear one or more instructions for performing aspects of a method 1700 as shown in FIG. 17. The one or more non-transitory machine-readable data storage media may bear one or more instructions for sensing a parameter indicative of the eating utensil being moved to or from the mouth of the consumer, e.g. one or more instructions for sensing proximity of the eating utensil to a skin surface of the consumer, or one or more instructions for sensing an acceleration. The one or more non-transitory machine-readable data storage media may bear one or more instructions for determining the rate at which the utensil is moved to or from the mouth of the consumer. The one or more non-transitory machine-readable data storage media may further bear one or more instructions for controlling release of the at least one odorant from the at least one controllable odorant emitter based at least in part on a rate at which the utensil is moved to the mouth of the consumer. In an aspect, the one or more non-transitory machine-readable data storage media bear one or more instructions for determining how many times the eating utensil is moved to or from the mouth of the consumer. Additionally, the one or more non-transitory machine-readable data storage media may bear one or more instructions for controlling release of the at least one odorant from the at least one controllable odorant emitter based at least in part on how many times the eating utensil is moved to the mouth of the consumer. In another aspect, the one or more non-transitory machine-readable data storage media bear one or more instructions for sensing a parameter indicative of a weight of the ingestible substance carried by the ingestible substance-carrying portion with a sensor carried by the eating utensil, including, for example, a force, a pressure, a strain, or a resonant frequency.

The one or more non-transitory machine-readable data storage media 2302 may bear one or more instructions for performing aspects of a method 1800 as shown in FIG. 18, including one or more instructions for sensing a parameter indicative of a component of the ingestible substance carried by the ingestible substance-carrying portion with a sensor carried by the eating utensil. In connection therewith, the one or more non-transitory machine-readable data storage media may bear one or more instructions for controlling release of the at least one odorant from the at least one controllable odorant emitter based at least in part on the component of the ingestible substance. In an aspect, the one or more instructions for sensing the parameter indicative of the component of the ingestible substance include one or more instructions for sensing a chemical. In various aspects, for example, the one or more instructions for sensing the parameter indicative of the component of the ingestible substance include one or more instructions for sensing a salt, a sugar, a protein, a fat, an alcohol, or a pH.

The one or more non-transitory machine-readable data storage media 2302 may bear one or more instructions for performing aspects of a method 1900 as shown in FIG. 19, including one or more instructions for actuating at least one gate actuation mechanism to open at least one gate. In an aspect, the at least one controllable odorant emitter includes at least one odorant sealed within a reservoir by a puncturable membrane, in which case the one or more instructions for releasing the at least one odorant from the at least one controllable odorant emitter may include one or more instructions for controlling at least one controllable puncture mechanism to puncture the at least one puncturable membrane. In another aspect, the at least one controllable odorant emitter includes at least one odorant retained within a reservoir by a valve, and in connection therewith the one or more instructions for releasing the at least one odorant from the at least one controllable odorant emitter may include one or more instructions for controlling at least one valve actuation mechanism to open at least one valve. In some aspects, the at least one controllable odorant emitter includes at least one expulsion mechanism adapted to expel the odorant from the controllable odorant emitter, and the one or more instructions for releasing the at least one odorant from the at least one controllable odorant emitter include one or more instructions for activating the at least one expulsion mechanism which may include, for example, instructions for activating at least one heating mechanism or instructions for activating at least one propulsion mechanism, as described herein above.

In an aspect, the one or more non-transitory machine-readable data storage media 2302 bear one or more instructions for performing aspects of a method 2000 as shown in FIG. 20. For example, the one or more non-transitory machine-readable data storage media bear one or more instructions for releasing a second odorant, wherein the at least one odorant released from the at least one controllable odorant emitter is a first odorant released from a first controllable odorant emitter. In an aspect, the one or more non-transitory machine-readable data storage media bear one or more instructions for releasing the second odorant from the first controllable odorant emitter; alternatively, the one or more non-transitory machine-readable data storage media may bear one or more instructions for releasing the second odorant from a second controllable odorant emitter. The one or more non-transitory machine-readable data storage media bear one or more instructions for releasing the first odorant and the second odorant at different times, or for mixing the first odorant and the second odorant.

In an aspect, the one or more non-transitory machine-readable data storage media 2302 bear one or more instructions for performing aspects of a method 2100 as shown in FIG. 21, including one or more instructions for releasing the at least one odorant from the at least one controllable odorant emitter according to a program. In an aspect, the one or more non-transitory machine-readable data storage media bear one or more instructions for sensing a parameter with a sensor carried by the eating utensil and modifying the release of the at least one odorant from the at least one controllable odorant emitter according to the program in response to the sensed parameter. In an aspect, the one or more instructions for releasing the at least one odorant from the at least one controllable odorant emitter according to a program include one or more instructions for releasing the at least one odorant according to a predetermined instruction set under control of control circuitry carried by the eating utensil. In an aspect, the one or more non-transitory machine-readable data storage media bear one or more instructions for receiving the predetermined instruction set from a user via a user input device. Alternatively, or in addition, the one or more non-transitory machine-readable data storage media may bear one or more instructions for receiving the predetermined instruction set from a remote device.

In an aspect, the one or more instructions for releasing the at least one odorant from the at least one controllable odorant emitter according to a program include one or more instructions for releasing the at least one odorant according to a predetermined set of parameters under control of control circuitry carried by the eating utensil. The one or more non-transitory machine-readable data storage media bear one or more instructions for receiving the predetermined set of parameters from a user via a user input device, or for receiving the predetermined set of parameters from a remote device.

The one or more non-transitory machine-readable data storage media 2302 may bear one or more instructions for performing aspects of a method 2200 as shown in FIG. 22, including one or more instructions for detecting the start of use of the eating utensil. In an aspect, the one or more non-transitory machine-readable data storage media furthermore bear one or more instructions for releasing the at least one odorant from the at least one controllable odorant emitter upon detecting the start of use of the eating utensil. In connection therewith, the one or more non-transitory machine-readable data storage media may bear one or more instructions for detecting the start of use of the eating utensil by at least one of detecting activation of a user-activatable switch, detecting a repetitive pattern in a signal sensed from a sensor carried by the eating utensil, determining that the eating utensil is being moved to or from the mouth of the consumer, detecting at least a component of the ingestible substance, or detecting a weight of the ingestible substance carried by the eating utensil. In an aspect, the one or more non-transitory machine-readable data storage media bear one or more instructions for determining how many bites of the ingestible substance have been taken from the eating utensil, or determining how many sips of the ingestible substance have been taken from the eating utensil. The one or more non-transitory machine-readable data storage media may bear one or more instructions for determining how long the eating utensil has been in use. In addition, the one or more non-transitory machine-readable data storage media may bear one or more instructions for controlling release of the at least one odorant from the at least one controllable odorant emitter based at least in part on how long the eating utensil has been in use. The one or more instructions for controlling release of the at least one odorant from the at least one controllable odorant emitter based at least in part on how long the eating utensil has been in use may include one or more instructions for starting release of the at least one odorant after the eating utensil has been in use for a specified amount of time, ending release of the at least one odorant after the eating utensil has been in use for a specified amount of time, starting release of at least a second odorant after the eating utensil has been in use for a specified amount of time, or for starting release of at least one odorant from at least one second location on the eating utensil after the eating utensil has been in use for a specified amount of time.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly interactable, and/or wirelessly interacting components, and/or logically interacting, and/or logically interactable components.

In some instances, one or more components may be referred to herein as "configured to," "configured by," "configurable to," "operable/operative to," "adapted/adaptable," "able to," "conformable/conformed to," etc. It will be recognized that such terms (e.g. "configured to") generally encompass active-state components and/or inactive-state components and/or standby-state components, unless context requires otherwise.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, It will be recognized that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method of delivering an odorant in connection with use of an eating utensil for delivering food or drink to a consumer, comprising:

releasing at least one odorant from at least one controllable odorant emitter carried by an eating utensil in response to a control signal generated by control circuitry carried by the eating utensil and operatively connected to the at least one controllable odorant emitter, the eating utensil comprising:

an ingestible substance-carrying portion adapted to carry a quantity of an ingestible substance to a mouth of a consumer; and a support portion connected to the ingestible substance-carrying portion and configured to be engaged by a person's hand to permit the ingestible substance-carrying portion to be thereby moved to the mouth of the consumer.

2. The method of claim 1, comprising receiving a signal from a remote device with a receiver carried by the eating utensil.

3. The method of claim 1, wherein the at least one controllable odorant emitter is a part of the eating utensil.

4. The method of claim 1, wherein the at least one controllable odorant emitter is a part of an attachment to the eating utensil, wherein the attachment is removably securable to the eating utensil such that the when secured to the eating utensil the attachment and parts thereof are carried by the eating utensil.

5. The method of claim 1, comprising sensing a parameter indicative of at least a portion of the ingestible substance-carrying portion being inside the mouth of the consumer with a sensor carried by the eating utensil.

6. The method of claim 1, comprising sensing a parameter indicative of the eating utensil being moved to or from the mouth of the consumer.

7. The method of claim 6, including at least one of sensing proximity of the eating utensil to a skin surface of the consumer, sensing an acceleration, determining a rate at which the utensil is moved to or from the mouth of the consumer and determining how many times the eating utensil is moved to or from the mouth of the consumer.

8. The method of claim 1, comprising sensing a parameter indicative of a weight of the ingestible substance carried by the ingestible substance-carrying portion with a sensor carried by the eating utensil.

9. The method claim 1, comprising sensing a parameter indicative of a component of the ingestible substance carried by the ingestible substance-carrying portion with a sensor carried by the eating utensil.

10. The method of claim 1, comprising releasing the at least one odorant from the at least one controllable odorant emitter according to a program.

11. The method of claim 10, wherein releasing the at least one odorant from the at least one controllable odorant emitter according to a program includes releasing the at least one odorant according to a predetermined instruction set under control of control circuitry carried by the eating utensil.

12. The method of claim 1, comprising detecting a start of use of the eating utensil.

13. The method of claim 12, comprising controlling release of the at least one odorant from the at least one controllable odorant emitter based at least in part on how long the eating utensil has been in use.

14. The method of claim 13, wherein controlling release of the at least one odorant from the at least one controllable odorant emitter based at least in part on how long the eating utensil has been in use includes at least one of starting release of the at least one odorant after the eating utensil has been in use for a specified amount of time, ending release of the at least one odorant after the eating utensil has been in use for a specified amount of time, starting release of at least a second odorant after the eating utensil has been in use for a specified amount of time, and starting release of at least one odorant from at least one second location on the eating utensil after the eating utensil has been in use for a specified amount of time.

15. The method of claim 12, wherein detecting the start of use of the eating utensil includes at least one of detecting activation of a user-activatable switch, detecting a repetitive pattern in a signal sensed from a sensor carried by the eating utensil, determining that the eating utensil is being moved to or from the mouth of the consumer, detecting at least a component of the ingestible substance, and detecting a weight of the ingestible substance carried by the eating utensil.

16. A method of delivering an odorant in connection with use of an eating utensil for delivering food or drink to a consumer, comprising:

releasing at least one odorant from at least one controllable odorant emitter carried by an eating utensil in response to a control signal, the eating utensil comprising:

an ingestible substance-carrying portion adapted to carry a quantity of an ingestible substance to a mouth of a consumer; and a support portion connected to the ingestible substance-carrying portion and configured to be engaged by a person's hand to permit the ingestible substance-carrying portion to be thereby moved to the mouth of the consumer;

wherein the at least one controllable odorant emitter includes at least one expulsion mechanism adapted to expel the odorant from the controllable odorant emitter, and wherein releasing the at least one odorant from the at least one controllable odorant emitter includes activating the at least one expulsion mechanism.

17. A method of delivering an odorant in connection with use of an eating utensil for delivering food or drink to a consumer, comprising:

releasing at least one odorant from at least one controllable odorant emitter carried by an eating utensil in response to a control signal, the eating utensil comprising:

an ingestible substance-carrying portion adapted to carry a quantity of an ingestible substance to a mouth of a consumer; and a support portion connected to the ingestible substance-carrying portion and configured to be engaged by a person's hand to permit the ingestible substance-carrying portion to be thereby moved to the mouth of the consumer;

comprising releasing a second odorant, wherein the at least one odorant released from the at least one controllable odorant emitter is a first odorant released from a first controllable odorant emitter; and wherein the method includes at least one of releasing the second odorant from the first controllable odorant emitter; releasing the second odorant from a second controllable odorant emitter; releasing a second odorant that is different from the first odorant; releasing the first odorant and the second odorant from controllable odorant emitters located at two spatially separated locations; releasing the first odorant and the second odorant at different times; and mixing the first odorant and the second odorant.

* * * * *